US010752004B2

(12) United States Patent
Fukushima

(10) Patent No.: US 10,752,004 B2
(45) Date of Patent: Aug. 25, 2020

(54) LIQUID EJECTING APPARATUS AND CARTRIDGE

(71) Applicant: SEIKO EPSON CORPORATION, Tokyo (JP)

(72) Inventor: Shigeki Fukushima, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/115,002

(22) Filed: Aug. 28, 2018

(65) Prior Publication Data

US 2019/0061361 A1 Feb. 28, 2019

(30) Foreign Application Priority Data

Aug. 30, 2017 (JP) ..... 2017-166051

(51) Int. Cl.
*B41J 2/175* (2006.01)
*B41J 29/38* (2006.01)
*B41J 2/14* (2006.01)

(52) U.S. Cl.
CPC ..... *B41J 2/17509* (2013.01); *B41J 2/17506* (2013.01); *B41J 2/17546* (2013.01); *B41J 2/17563* (2013.01); *B41J 2/17566* (2013.01); *B41J 29/38* (2013.01); *B41J 2002/14403* (2013.01)

(58) Field of Classification Search
CPC ..... B41J 2/17563; B41J 2002/14403
See application file for complete search history.

(56) References Cited

U.S. PATENT DOCUMENTS 6,059,405 A 5/2000 Mochizuki et al.
2004/0113803 A1* 6/2004 Keown ..... B01D 35/143 340/648
2017/0225482 A1* 8/2017 Shinoto ..... B41J 2/17563

FOREIGN PATENT DOCUMENTS

JP 11-048492 A 2/1999

* cited by examiner

*Primary Examiner* — Scott A Richmond
(74) *Attorney, Agent, or Firm* — Foley & Lardner LLP

(57) ABSTRACT

An ink jet printer includes an ink cartridge that has a storage chamber for storing ink and enables the storage chamber to be replenished with the ink, a print head that ejects the ink supplied from the storage chamber via a filter, a state estimation portion that estimates a state of the filter, and a notification portion that performs notification, wherein the notification portion performs different notification in accordance with an estimated state by the state estimation portion.

3 Claims, 13 Drawing Sheets

LIQUID EJECTING APPARATUS AND CARTRIDGE

CROSS-REFERENCE TO RELATED APPLICATIONS

This application claims priority to Japanese Appl. No. 2017-166051, filed Aug. 30, 2017; the contents of which are incorporated by reference herein in their entirety.

BACKGROUND

1. Technical Field

The present invention relates to a liquid ejecting apparatus and a cartridge.

2. Related Art

As an existing liquid ejecting apparatus, there has been known an ink jet printer which includes a tank for storing ink and which performs printing by supplying the stored ink to a print head (see, for example, JP-A-11-48492). An ink jet printer disclosed in JP-A-11-48492 is configured such that a tank can be replenished with ink.

As in the ink jet printer disclosed in JP-A-11-48492, in the configuration in which the tank can be replenished with the ink, there is a risk that foreign matters may enter the tank with ink replenishment. It is therefore desirable to have the configuration in which, for example, a filter is provided as a configuration capable of removing the foreign matters mixed in the ink.

However, when the filter is provided in a liquid ejecting apparatus such as an ink jet printer, it is necessary to manage whether or not clogging of the filter, and the like has occurred.

SUMMARY

An advantage of some aspects of the invention is to reduce a burden on management of a filter state and the like when a filter capable of removing foreign matters mixed in a liquid is used in a liquid ejecting apparatus.

According to an aspect of the invention, a liquid ejecting apparatus includes a liquid storage portion that has a storage chamber for storing a liquid and enables the storage chamber to be replenished with the liquid, a liquid ejection portion that ejects the liquid supplied from the storage chamber via a filter, a state estimation portion that estimates a state of the filter, and a notification portion that performs notification, wherein the notification portion performs different notification in accordance with an estimated state by the state estimation portion.

According to the aspect of the invention, it is possible to estimate the state of the filter through which the liquid has passed and to perform notification to a user in accordance with the state of the filter, thereby reducing the burden on the management of the state of the filter, and the like.

Further, the liquid ejecting apparatus in the aspect of the invention may have a configuration in which the state estimation portion estimates that the filter is in a first state in which predetermined clogging occurs when an amount of the liquid supplied via the filter is larger than a liquid amount threshold value.

With this configuration, by comparing the amount of liquid supplied via the filter with the liquid amount threshold value, it is possible to accurately estimate whether the filter is in the state in which the predetermined clogging occurs.

In addition, the liquid ejecting apparatus in the aspect of the invention may have a configuration in which a pump that sucks the liquid supplied from the storage chamber via the filter and delivers the liquid to the liquid ejection portion is provided, and the state estimation portion estimates that the filter is in a second state in which predetermined clogging occurs when a load of the pump is larger than a load threshold value.

With this configuration, by comparing the load of the pump that sucks the liquid supplied via the filter with the load threshold value, it is possible to accurately estimate whether the filter is in the state in which the predetermined clogging occurs.

In addition, the liquid ejecting apparatus in the aspect of the invention may have a configuration in which in the first state, the notification portion performs notification to limit replenishment of the storage chamber with the liquid, and in the second state, the notification portion further performs notification related to replacement of the liquid storage portion.

With this configuration, it is possible to perform the notification in accordance with each of a plurality of states of the filter.

According to another aspect of the invention, a cartridge includes a filling port through which a liquid is capable of being filled, a storage chamber that stores the liquid, a filter that allows the liquid to pass through when the liquid is supplied to outside from the storage chamber, and a storage medium that is capable of storing information indicating an amount of the liquid supplied through the filter, wherein the storage medium is capable of storing the information until the liquid of a volume of equal to or more than two times of a volume of the storage chamber is supplied through the filter.

According to the aspect of the invention, the filter can be replaced by replacing the cartridge that can be replenished with the liquid. Further, the information about the liquid that has passed through the filter can be stored in the storage medium of the cartridge, and the state of the filter can be estimated using the information stored in the storage medium. Even when the cartridge is used in a plurality of different liquid ejecting apparatuses, the state of the filter can be estimated using the information stored in the storage medium of the cartridge in any of the liquid ejecting apparatuses.

In addition, the cartridge in the aspect of the invention may have a configuration in which the filter allows the liquid of a volume of at least equal to or more than 10 times of the volume of the storage chamber to pass through, and the storage medium is capable of storing information corresponding to an upper limit of an amount of the liquid which is capable of being supplied through the filter.

With this configuration, it is possible to store, in the storage medium, the amount of the liquid that has passed through the filter up to the upper limit of the amount which is capable of being supplied through the filter. Therefore, the state of the filter can be managed based on the information stored in the storage medium of the cartridge until the state of the filter reaches the so-called end of its lifetime.

Further, the cartridge in the aspect of the invention may have a configuration in which the storage medium has a storage area for storing the information indicating the amount of the liquid supplied through the filter using, as a unit, the volume of the storage chamber.

With this configuration, it is possible to reduce the capacity of the storage area of the storage medium. Further, by using the information stored in the storage medium of the cartridge and the amount of storable liquid in accordance with the volume of the storage chamber, it is possible to measure the amount of liquid that has passed through the filter.

The aspect of the invention can be realized in various forms other than the above-described liquid ejecting apparatus. For example, it may be implemented as a program that is executed by a computer (or processor) to perform pieces of processing of the apparatus described above. Further, the aspect of the invention can also be realized in the forms of a recording medium in which the above program is recorded, a server apparatus which distributes the program, a transmission medium which transmits the program, and a data signal which embodies the program in carrier waves.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an ink jet printer 1 according to an embodiment to which the invention is applied will be described with reference to the accompanying drawings.

Figure 1:
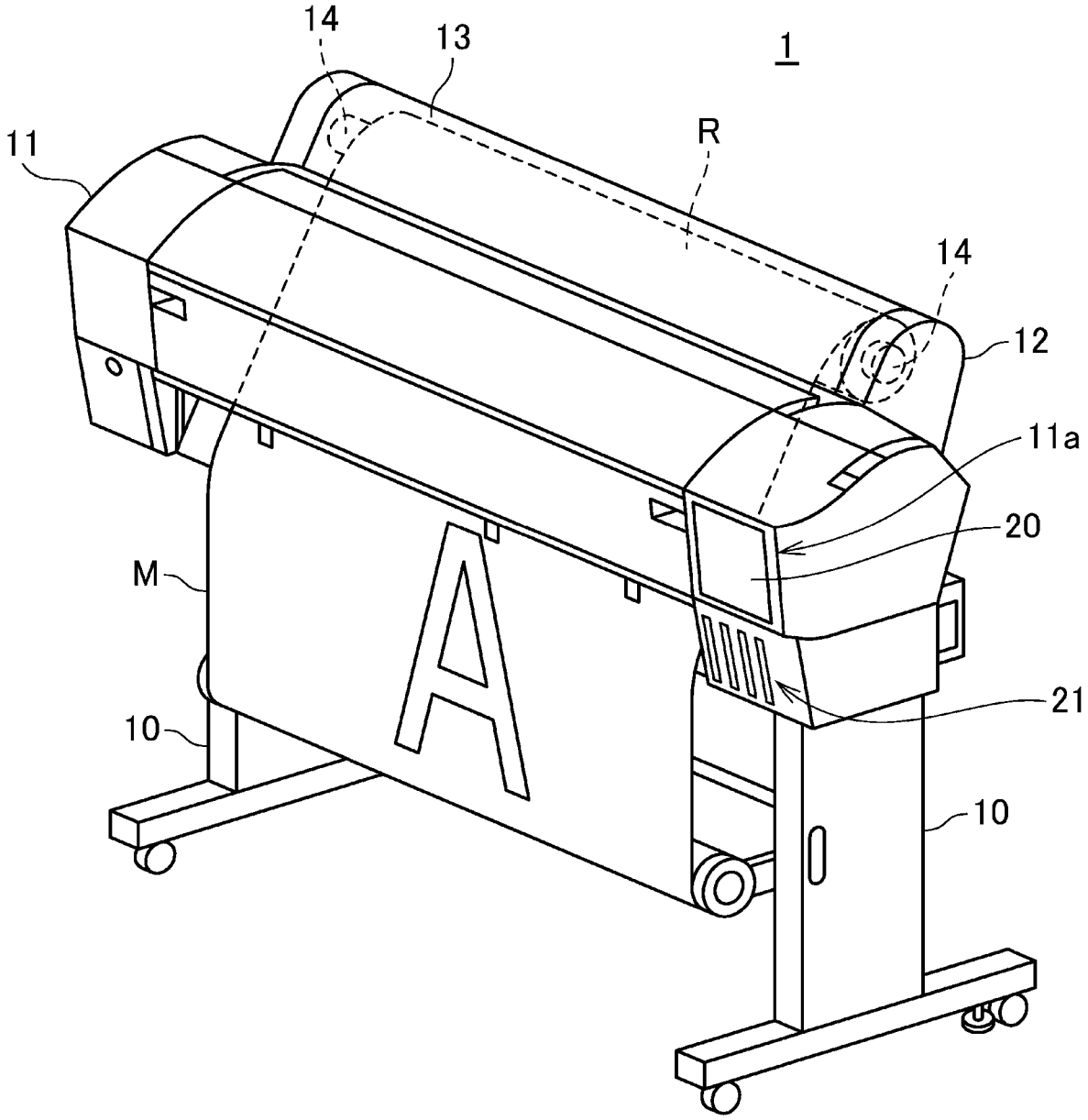
FIG. 1 is an outer perspective view of an ink jet printer according to an embodiment.

FIG. 1 is an outer perspective view of the ink jet printer 1.

The ink jet printer 1 (liquid ejecting apparatus) illustrated in FIG. 1 is a printing apparatus that prints characters, images, and the like on an elongated medium M as an example of a print medium by an ink jet method. The ink jet printer 1 is connected to a host computer (not illustrated), for example, and performs printing under control by the host computer.

The number of ink colors to be used in the ink jet printer 1 is arbitrary. In this embodiment, as an example, a configuration is described in which inks of four colors of cyan (C), magenta (M), yellow (Y), and black (K) are used for printing.

The ink jet printer 1 includes a substantially rectangular parallelepiped main body 11 supported by a pair of legs 10. In the following description, the side seen in FIG. 1 is defined as the front side of the main body 11, and the left and right sides in the drawing are defined as the left and right sides of the main body 11.

The ink jet printer 1 is provided with a feeding portion 12 for storing therein a roll body R formed by winding the medium M in a roll shape at a rear part of the main body 11. The feeding portion 12 is provided with a flip-up type opening/closing cover 13, and can be replenished with the roll body R in a state in which the opening/closing cover 13 is opened. A pair of roll body support portions 14 for supporting the roll body R is disposed in the feeding portion 12. The roll body support portions 14 are connected to a feeding motor (not illustrated) and rotates the roll body R by driving force of the feeding motor. As the roll body R rotates, the medium M is fed from the feeding portion 12 into the main body 11.

A touch panel 20 which displays various kinds of information related to an operation state of the ink jet printer 1 and detects a touch operation by a user is disposed on a front right portion 11*a* of the main body 11.

An ink cartridge storage portion 21 is provided under the touch panel 20. Ink cartridges 30 (FIG. 2) storing therein inks to be used for printing by the ink jet printer 1 are stored in the ink cartridge storage portion 21. The ink cartridges 30 are detachable from the ink cartridge storage portion 21 and can be replaced by detaching the ink cartridges 30 from the ink cartridge storage portion 21. In this case, the ink jet printer 1 may be configured to be capable of detaching the ink cartridges 30.

Figure 2:
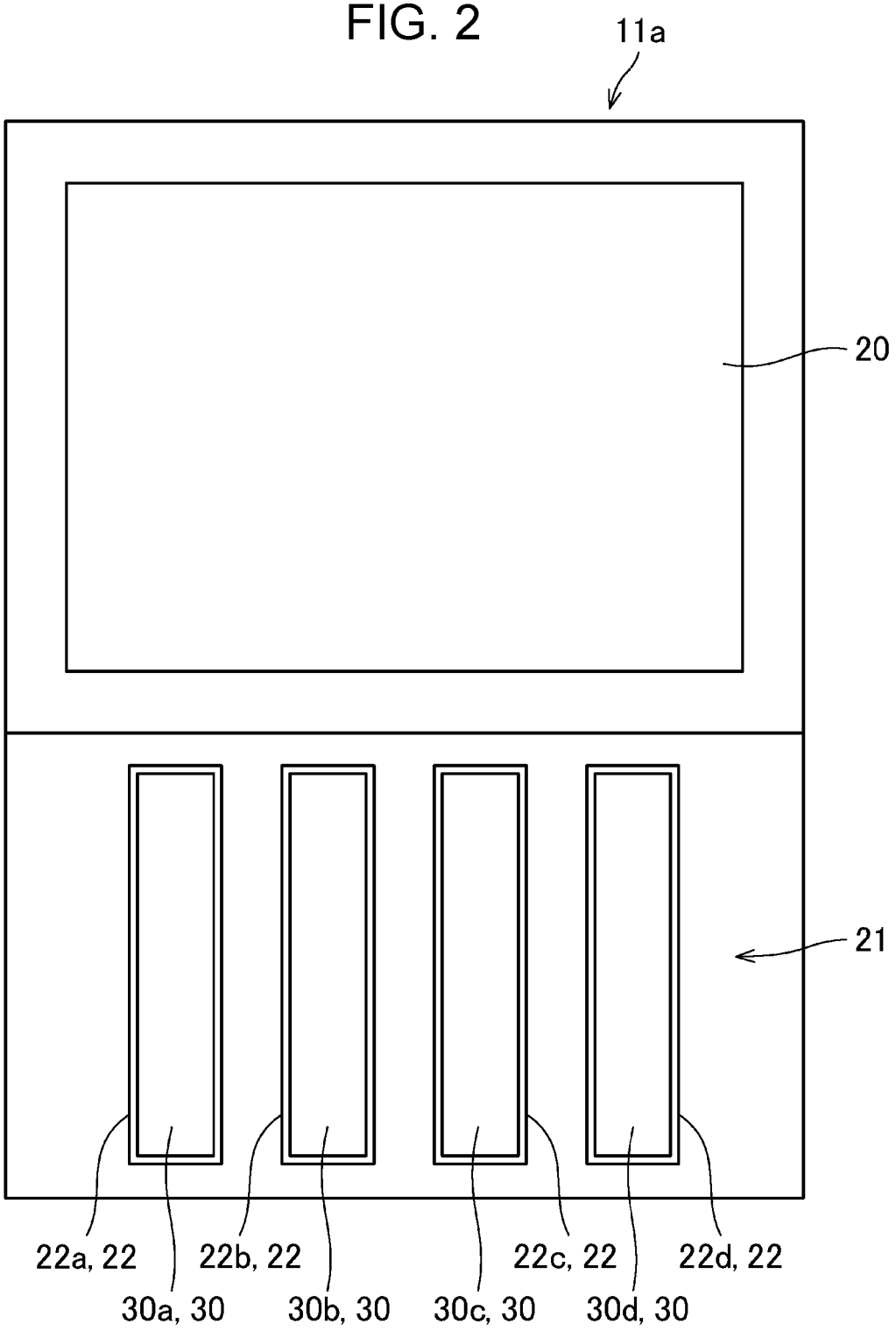
FIG. 2 is a front view of a main part of the ink jet printer.

FIG. 2 is a front view of a main part of the ink jet printer 1.

As illustrated in FIG. 2, the ink cartridge storage portion 21 includes four mounting portions 22*a*, 22*b*, 22*c*, and 22*d* in order to mount thereon four ink cartridges 30 which each store therein the inks of the four colors to be used in the ink jet printer 1.

The mounting portions 22*a* to 22*d* are arranged side by side in the left-right direction. Ink cartridges 30*a*, 30*b*, 30*c*, and 30*d* are mounted on the mounting portions 22*a*, 22*b*, 22*c*, and 22*d*, respectively. The ink cartridge 30*a* stores the cyan ink, the ink cartridge 30*b* stores the magenta ink, the ink cartridge 30*c* stores the yellow ink, and the ink cartridge 30*d* stores the black ink.

In the following description, when the mounting portions 22*a*, 22*b*, 22*c*, and 22*d* are not distinguished from one another, they will be referred to as a mounting portion 22. When the ink cartridges 30*a*, 30*b*, 30*c*, and 30*d* are not distinguished from one another, they will be referred to as the ink cartridge 30. Similarly, when IC chips 34*a*, 34*b*, 34*c*, and 34*d* (FIG. 4), which will be described later, are not distinguished from one another, they will be referred to as an IC chip 34, and when reading portions 23*a*, 23*b*, 23*c*, and 23*d* (FIG. 4), which will be described later, are not distinguished from one another, they will be referred to as a reading portion 23.

Figure 3:
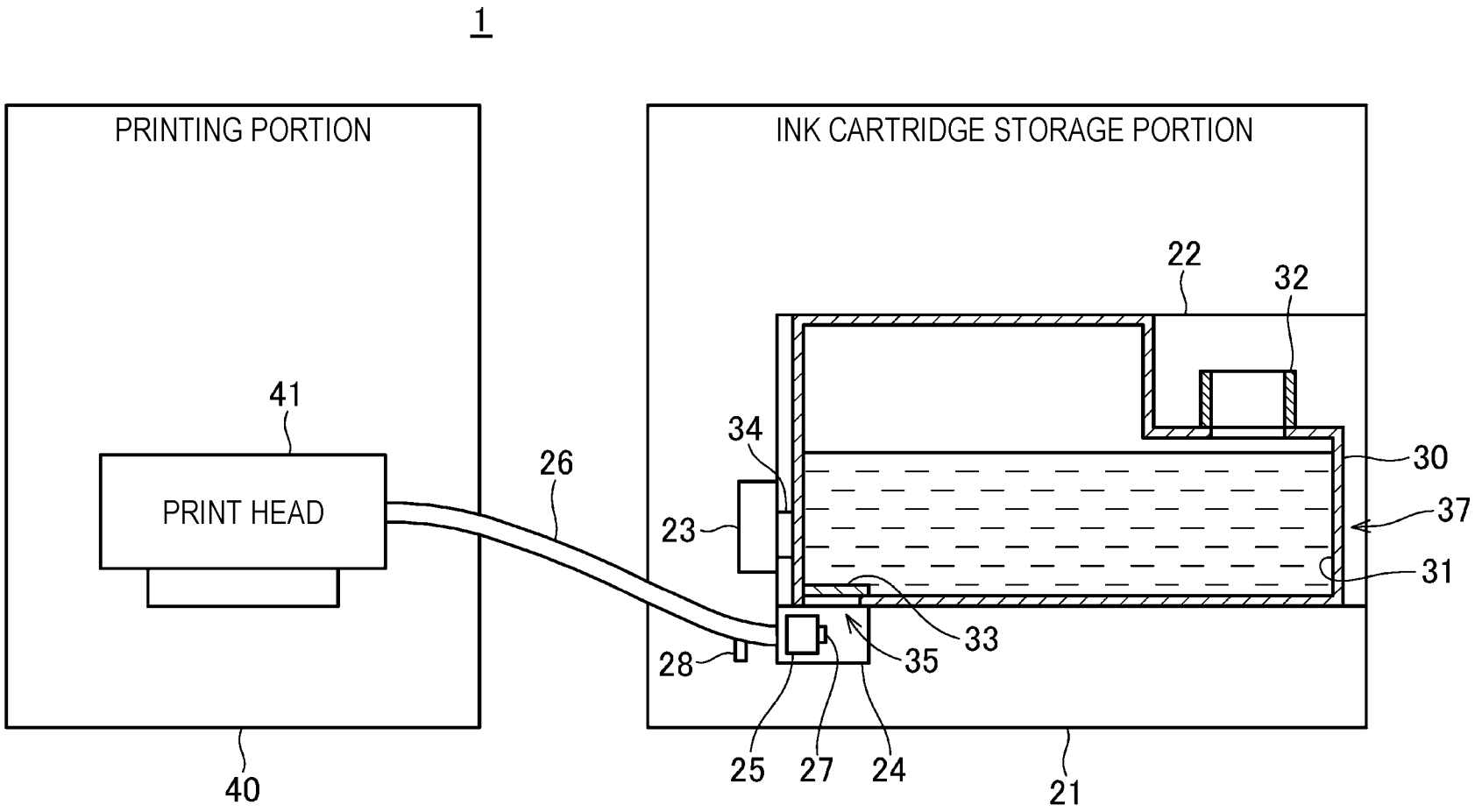
FIG. 3 is a schematic view illustrating a main part of the ink jet printer.

FIG. 3 is a schematic view illustrating a main part of the ink jet printer 1.

As illustrated in FIG. 3, the ink jet printer 1 includes a printing portion 40 provided with a print head 41 (liquid ejection portion) that ejects ink onto the medium M. The ink is supplied from the ink cartridge 30 mounted on the mounting portion 22 to the print head 41 via a tube 26.

Although FIG. 3 illustrates the configuration in which one ink cartridge 30 is connected via one tube 26, in practice, the four ink cartridges 30*a*, 30*b*, 30*c*, and 30*d* are connected to the print head 41 via individual four tubes 26. In FIG. 3, for the convenience of explanation, in the ink cartridge storage portion 21, the configuration related to the one ink cartridge 30 mounted on one mounting portion 22 is illustrated.

Each ink cartridge 30 has a hollow storage chamber 31 for storing therein the ink. Although the volume of the storage chamber 31 is arbitrary, in this embodiment, for example, 1 L (liter) of ink can be stored therein. In this embodiment, the ink cartridge 30 corresponds to a liquid storage portion in the invention. A translucent window portion 37 is formed on an outer wall of the storage chamber 31. In this configuration, the residual amount of ink stored in the storage chamber 31 is visible from the front of the ink jet printer 1 through the window portion 37.

A filling port 32 is provided at an upper portion of the ink cartridge 30. The filling port 32 is an opening communicating with the outside of the ink cartridge 30 and the storage chamber 31, and is sealed by a detachable cap member (not illustrated). With the cap member detached, the storage chamber 31 can be replenished with the ink through the filling port 32.

In the ink jet printer 1, ink replenishment can be performed by replacing the ink cartridge 30 with a small amount of ink remaining in the ink cartridge 30. Further, it is also possible to detach the ink cartridge 30 from the mounting portion 22 and replenish the ink cartridge 30 with the ink through the filling port 32. In this case, by mounting the ink cartridge 30 replenished with the ink on the mounting portion 22, printing can be continued by the ink jet printer 1. In other words, by replenishing the ink cartridge 30 with the ink through the filling port 32, the same ink cartridge 30 can be repeatedly used.

Each ink cartridge 30 is provided with a filter 33 for removing foreign matters mixed in the ink. The filter 33 is formed into a mesh shape, a sheet shape, or a net shape, and is formed of, for example, a nonwoven fabric or a metallic net.

A discharge port 35 communicating with the tube 26 is provided at the bottom of the storage chamber 31, and the filter 33 is mounted on or near the discharge port 35.

The ink jet printer 1 includes a pump 24 that sucks the ink from the ink cartridge 30. As illustrated in FIG. 3, for example, the pump 24 is provided just under the ink cartridge 30 and communicates with the discharge port 35 of the ink cartridge 30 mounted on the mounting portion 22. The pump 24 includes a pump motor 25, and supplies the ink in the storage chamber 31 to the tube 26 by driving force of the pump motor 25. Thus, the ink is transferred from the ink cartridge 30 to the print head 41, and is used for printing.

The ink jet printer 1 includes a pump motor rotation detection portion 27 and a temperature sensor 28 (temperature detection portion). As illustrated in FIG. 3, for example, the pump motor rotation detection portion 27 is provided in the pump motor 25 and detects the rotation of the pump motor 25. The pump motor rotation detection portion 27 is configured using, for example, an encoder or a resolver.

The temperature sensor 28 is a sensor for detecting the temperature of the ink, and is configured by, for example, a thermistor. To be specific, the temperature sensor 28 is utilized to detect the temperature of the ink to be delivered by the pump 24 or the temperature of the ink passing through the filter 33. It is therefore preferable that the temperature sensor 28 be disposed at a position close to the filter 33 or the pump 24. Specifically, the temperature sensor 28 is attached to the tube 26. More preferably, the temperature sensor 28 is positioned in contact with or proximate to the tube 26 in the ink cartridge storage portion 21.

The ink cartridge 30 includes the IC (Integrated Circuit) chip 34 which is a storage medium. The IC chip 34 includes a nonvolatile memory and has a storage area for storing data in a nonvolatile and rewritable manner. As illustrated in FIG. 3, the IC chip 34 is mounted on an outer surface of the ink cartridge 30, for example.

The ink cartridge storage portion 21 is provided with the reading portion 23 which executes writing and reading of information into and from the IC chip 34 in a state in which the ink cartridge 30 is mounted on the mounting portion 22. When the ink cartridge 30 includes the contact type IC chip 34, the reading portion 23 makes contact and communicates with the IC chip 34. Alternatively, when the ink cartridge 30 includes the non-contact type IC chip 34, the reading portion 23 includes an antenna (not illustrated) and an RF circuit (not illustrated) for making non-contact communication with the IC chip 34.

As described above, the plurality of ink cartridges 30 storing therein the inks of the respective colors can be stored in the ink cartridge storage portion 21, and the mounting portions 22 the number of which corresponds to the number of ink cartridges 30 are provided therein. The plurality of reading portions 23 are arranged so as to correspond to the respective mounting portions 22, and the ink jet printer 1 can individually write and read pieces of data into and from the IC chips 34 of the respective ink cartridges 30.

Further, the reading portion 23, the pump 24, the pump motor 25, the pump motor rotation detection portion 27, and the temperature sensor 28 illustrated in FIG. 3 are provided so as to correspond to each ink cartridge 30 mounted on the mounting portion 22. In the embodiment, the four reading portions 23, the four pumps 24, the four pump motors 25, the four pump motor rotation detection portions 27, and the four temperature sensors 28 can be installed so as to each correspond to the four ink cartridges 30*a* to 30*d*.

Figure 4:
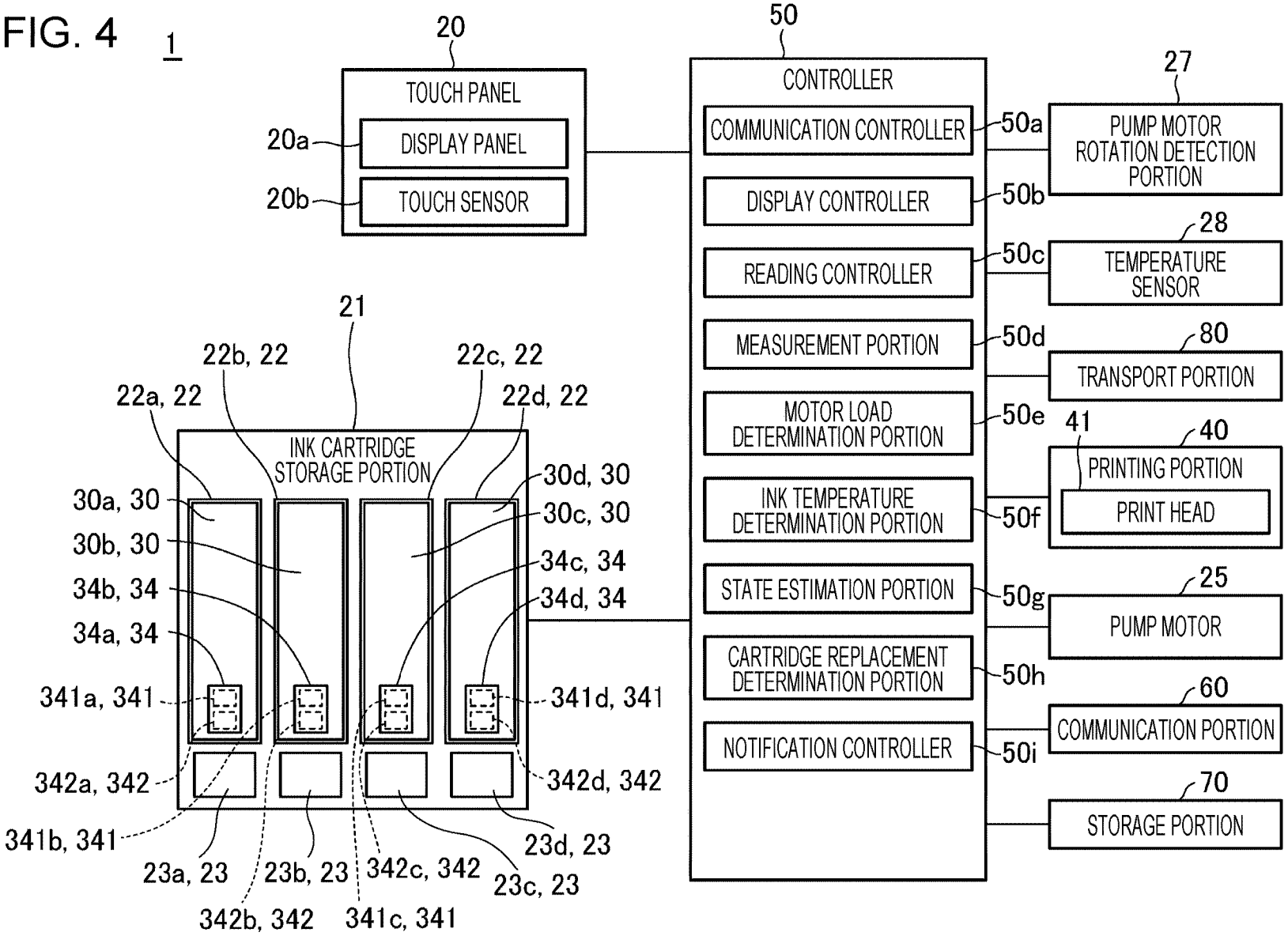
FIG. 4 is a block diagram illustrating a configuration of a control system of the ink jet printer.

FIG. 4 is a block diagram illustrating a configuration of a control system of the ink jet printer 1.

The ink jet printer 1 includes a controller 50.

The controller 50 includes a processor (not illustrated) such as a CPU (Central Processing Unit) and a microcomputer, and controls the respective portions of the ink jet printer 1 by executing programs by the processor. In addition to the processor, the controller 50 may include a RAM (Random Access Memory), a ROM (Read Only Memory), and the like. The RAM forms a work area for temporarily storing programs that are executed by the processor, pieces of data to be processed, and the like. The ROM stores therein basic control programs that are executed by the processor and pieces of data including various set values and the like in a nonvolatile manner.

The touch panel 20, the ink cartridge storage portion 21, a communication portion 60, and a storage portion 70 are connected to the controller 50. Further, the pump motor rotation detection portions 27 and the temperature sensors 28 as sensors to be controlled are connected to the controller 50, and the controller 50 acquires detection values of these sensors. These sensors may be connected to the controller 50 via sensor driving elements such as gate arrays (not illustrated).

The touch panel 20 includes a display panel 20*a* and a touch sensor 20*b*. The display panel 20*a* is configured by a liquid crystal display, an electro luminescent (EL) display, or the like. The display panel 20*a* functions as a display portion and a notification portion displaying various kinds of images, and displays various kinds of information under control by the controller 50. The touch sensor 20*b* detects a touch operation on the touch panel 20 by a user, and outputs an operation signal indicating an operation position to the controller 50. Based on the signal from the touch sensor 20*b*, the controller 50 executes processing corresponding to the touch operation by the user.

FIG. 4 illustrates the IC chips 34*a*, 34*b*, 34*c* and 34*d* included in the ink cartridges 30*a*, 30*b*, 30*c*, and 30*d*, respectively. Similarly, the reading portions 23*a*, 23*b*, 23*c*, and 23*d* provided so as to respectively correspond to the mounting portions 22*a*, 22*b*, 22*c*, and 22*d* in the ink cartridge storage portion 21 are illustrated.

Although the data stored in each IC chip 34 can be arbitrarily configured, in the embodiment, the data stored in the IC chip 34 includes identification information capable of identifying the ink cartridge 30. The identification information is, for example, a serial number applied to the individual ink cartridge 30. For example, the identification information can be used to determine whether or not the new and old ink cartridges 30 are the same as each other when the ink cartridge 30 mounted on the mounting portion 22 is detached and the ink cartridge 30 is newly mounted.

Further, the data stored in each IC chip 34 includes information about the amount of ink that has passed through the filter 33 (hereinafter, referred to as an ink passage amount). For example, data including information indicating the amount of ink that has passed through the filter 33 included in the ink cartridge 30*a* is stored in the IC chip 34*a* mounted on the ink cartridge 30*a*. The information is, for example, the number of times that the ink cartridge 30 is replenished with the ink (hereinafter, referred to as the number of times of ink replenishment) or the amount of ink consumed (ejected) by the print head 41 (hereinafter, referred to as an ink consumption amount).

In other words, the ink jet printer 1 utilizes the number of times of ink replenishment and/or the ink consumption amount as an amount which is correlated with the amount of ink that has passed through each filter 33 and which can be detected, measured, or calculated. The number of times of ink replenishment can be obtained by a method of detecting that the user has replenished the ink cartridge 30 with the ink or a method of causing the user to input the ink replenishment. Further, in the control of driving the print head 41, the controller 50 specifies one of nozzles for ejecting the ink through the nozzle (not illustrated) of the print head 41, so that the amount of ink ejected from the print head 41 can be calculated by the controller 50.

The amount of ink replenished to each ink cartridge 30 at one time (hereinafter, referred to as a "replenishment amount") can be estimated from the size of an ink package prepared for replenishment or the capacity of the storage chamber 31. Therefore, by multiplying the number of times of ink replenishment by the amount of ink replenished to the ink cartridge 30 at one time, the amount of ink supplied from the ink cartridge 30 to the print head 41 can be calculated, and the amount of ink can be regarded as the ink passage amount.

Each filter 33 removes foreign matters mixed in the ink delivered from the storage chamber 31 to the tube 26. Therefore, as the larger amount of ink passes through the filter 33, the larger amount of foreign matters are collected by the filter 33, which may result in lowering of filtering performance. For this reason, it is recommended for a user of the ink jet printer 1 to replace the filter 33 before the filter 33 is clogged. Replacement of the filter 33 can be easily performed by replacing the ink cartridge 30 as described above.

The ink jet printer 1 performs notification to the user for prompting the replacement of the filter 33 before trouble due to clogging of the filter 33, or the like, occurs. For this purpose, in the ink jet printer 1, a threshold value is set as a "lifetime" of the filter 33. The lifetime of the filter 33 is set as a value of the ink passage amount, and is, for example, several ten liters. When the ink passage amount obtained from the number of times of ink replenishment or the ink consumption amount stored in the IC chip 34 exceeds the threshold value set as the lifetime, the ink jet printer 1 performs the notification. An operation related to the notification will be described later.

Each IC chip 34 has a storage area 341 for storing therein the identification information described above and a storage area 342 for storing therein information about the ink passage amount. Specifically, the IC chip 34*a* has a storage area 341*a* for storing therein the identification information and a storage area 342*a* for storing therein information about the ink passage amount. Similarly, the IC chips 34*b*, 34*c*, and 34*d* have storage areas 341*b*, 341*c*, and 341*d*, and storage areas 342*b*, 342*c*, and 342*d*, respectively.

The storage areas 341*a*, 341*b*, 341*c*, and 341*d* store therein the pieces of identification information unique to the ink cartridges 30*a*, 30*b*, 30*c*, and 30*d*, respectively.

The storage areas 342*a*, 342*b*, 342*c*, and 342*d* store therein pieces of information about the ink passage amounts of the filters 33 included in the ink cartridges 30*a*, 30*b*, 30*c*, and 30*d*, respectively. Therefore, the storage areas 342*a*, 342*b*, 342*c*, and 342*d* are areas having capacities capable of storing at least upper limit values of the ink passage amounts. The upper limit value of the ink passage amount is, for example, the ink passage amount set as the lifetime of the filter 33.

Taking as an example the case in which the lifetime of each filter 33 is set to 50 L, when the storage area 342 stores therein the number of times of ink replenishment, the upper limit value of the number of times of ink replenishment is "50" because the capacity of the ink cartridge 30 is 1 L. When this value ("50" of a decimal number) is written into the storage area 342 as, for example, binary data, the storage area 342 has a capacity capable of storing a value of at least 6 bits so as to store "110010". This is also true when the storage area 342 stores the ink consumption amount. In this case, if the unit of the ink consumption amount is appropriately set in accordance with the value of the lifetime of the filter 33, such as liter (L) and milliliter (mL), the number of digits of data to be stored in the storage area 342 can be reduced. As described above, in this embodiment, the lifetime of the filter 33 is represented by the number of times of ink replenishment or the ink consumption amount, which is the information using the volume of the storage chamber 31 as a unit, and the information is stored in the IC chip 34.

The number of times of ink replenishment and/or the ink consumption amount stored in the IC chip 34 does/do not require strict management. It is sufficient that they are managed using the volume of the ink cartridge 30 as the unit as long as the lifetime of the filter 33 is set in consideration of a safety factor to such an extent that trouble due to the clogging of the filter 33, or the like, does not occur. Accordingly, storing the number of times of ink replenishment or the ink consumption amount in the IC chip 34 as an integer, for example, enables the lifetime of the filter 33 to be appropriately managed and eliminates the necessity of storing a number having a decimal part. Therefore, it is possible to reduce the necessary capacity of the storage area 342 and to effectively use the storage area of the IC chip 34.

Under the control by the controller 50, the communication portion 60, by wired or wirelessly, communicates with an external device such as the host computer (not illustrated), and receives commands and print data transmitted from the host computer and outputs them to the controller 50.

The storage portion 70 is configured by a semiconductor memory element or a magnetic storage device, and stores therein various pieces of data to be processed by the controller 50.

The storage portion 70 stores, for example, the pieces of identification information read from the IC chips 34*a* to 34*d* of the ink cartridges 30*a* to 30*d*.

The controller 50 is connected to a transport portion 80 that transports the medium M, the printing portion 40 that performs printing on the medium M, and the pump motor 25, as operation portions to be controlled. The transport portion 80 includes, for example, the feeding motor (not illustrated) for driving the roll body support portions 14 (FIG. 1).

Further, the pump motor 25 may be connected to the controller 50 via a motor control IC (not illustrated) that generates and outputs electric power for driving. In this case, the pump motor rotation detection portion 27 may be provided in the motor control IC. The pump motor 25 is subjected to, for example, PWM (Pulse Width Modulation) control by a voltage or a current supplied from the motor control IC.

The printing portion 40 includes a drive circuit (not illustrated) for driving the print head 41, a carriage (not illustrated) on which the print head 41 is mounted, a scanning motor (not illustrated) for causing the carriage to scan, a motor driver (not illustrated) for driving the scan motor, and the like, in addition to the print head 41.

In accordance with the control by the controller 50, the printing portion 40 causes the carriage to scan in the direction intersecting with the transport direction of the medium M and ejects ink from the print head 41, thereby printing characters, images, and the like on the medium M.

The controller 50 temporarily stores the commands and data received from the host computer through the communication portion 60 in a reception buffer (not illustrated). The controller 50 sequentially reads and executes the commands and data stored in the reception buffer. Based on the commands and print data, the controller 50 controls the transport portion 80, the printing portion 40, and the pump motor 25 to print, on the medium M, characters, images, and the like based on the print data received together with the commands.

The controller 50 includes a communication controller 50*a*, a display controller 50*b*, a reading controller 50*c*, a measurement portion 50*d*, a motor load determination portion 50*e*, an ink temperature determination portion 50*f*, a state estimation portion 50*g*, a cartridge replacement determination portion 50*h*, and a notification controller 50*i*. The controller 50 reads programs stored in the ROM or the like, and executes the programs by the processor, thereby functioning as the respective functional portions 50*a* to 50*i*.

The communication controller 50*a* controls the communication portion 60 to execute communication with the external device of the ink jet printer 1.

The display controller 50*b* controls to display various kinds of information such as characters and images on the display panel 20*a*.

Figure 5:
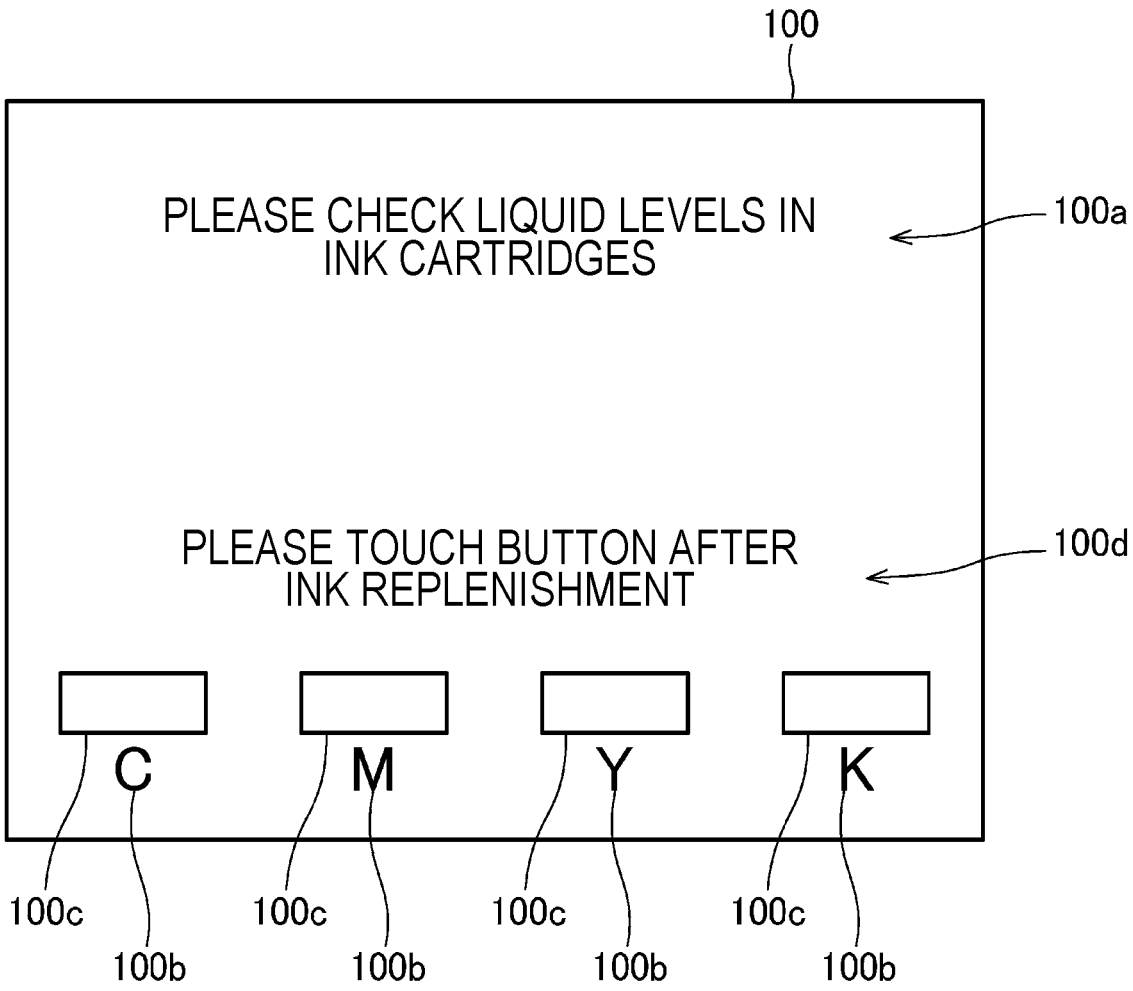
FIG. 5 is a view illustrating an example of a screen that is displayed on a display panel.

FIG. 5 is a view illustrating an example of a screen that is displayed on the display panel 20*a*, and illustrates a display screen 100 that is displayed in a state in which the ink jet printer 1 executes printing.

On the display screen 100, a message 100*a* prompting the user to check the liquid levels of the inks in the ink cartridges 30 is displayed. In addition, characters 100*b* indicating the respective ink colors are displayed in a lower portion of the display screen 100. The display positions of the characters 100*b* correspond to the positions of the ink cartridges 30*a* to 30*d* which are respectively mounted on the mounting portions 22*a* to 22*d* provided under the touch panel 20.

On the display screen 100, replenishment buttons 100*c* the number of which is the same as the number of ink cartridges 30*a* to 30*d* that are mounted on the mounting portions 22*a* to 22*d* are disposed so as to correspond to the positions of the ink cartridges 30*a* to 30*d*. Each replenishment button 100*c* is a replenishment button for receiving an operation when the user has replenished the ink cartridge 30 with the ink. In addition, a message 100*d* prompting the user to operate the replenishment button 100*c* when the user has replenished any of the ink cartridges with the ink is displayed on the display screen 100.

The reading controller 50*c* in FIG. 4 controls the respective reading portions 23*a* to 23*d* to individually write and read the pieces of information into and from the respective IC chips 34*a* to 34*d*. The pieces of information that are read from the IC chips 34*a* to 34*d* by the reading controller 50*c* are, for example, the pieces of identification information of the ink cartridges 30 and the ink passage amounts. Further, the pieces of information that are written into the IC chips 34*a* to 34*d* by the reading controller 50*c* are, for example, the pieces of information about the ink passage amounts.

The measurement portion 50*d* measures the ink passage amounts for the respective ink cartridges 30*a* to 30*d*. More specifically, in order to obtain the ink passage amounts, the measurement portion 50*d* measures the ink consumption amounts and/or the numbers of times of ink replenishment as the pieces of information about the ink passage amounts. When any of ink cartridges 30 has been replaced, that is, when a new ink cartridge 30 has been mounted on the mounting portion 22, the measurement portion 50*d* resets, to 0, the information about the ink passage amount corresponding to the mounted ink cartridge 30. The measurement portion 50*d* measures the pieces of information about the ink passage amounts in accordance with operations of the ink jet printer 1 and operations on the replenishment buttons 100*c* by the user.

As a specific measurement method by the measurement portion 50*d*, as described above, the method in which the ink consumption amounts are calculated by integrating the amounts of inks supplied to the print head 41 and the method in which the numbers of times of ink replenishment are counted based on the numbers of times of operations on the replenishment buttons 100*c* are exemplified. A method for obtaining the ink passage amounts from the ink consumption amounts and the numbers of times of ink replenishment is as described above.

The measurement portion 50*d* performs at least any one of measurement of the ink consumption amounts and counting of the numbers of times of ink replenishment. For example, whether the ink consumption amounts are measured or the numbers of times of ink replenishment are counted may be individually specified by presetting, an instruction by a user's operation, or a command input from the host computer (not illustrated). The measurement portion 50*d* may execute both of the measurement of the ink consumption amounts and the counting of the numbers of times of ink replenishment. The measurement portion 50*d* performs both of the measurement of the ink consumption amounts and the counting of the numbers of times of ink replenishment for the respective ink cartridges 30. Specifically, the measurement portion 50*d* stores the ink consumption amounts and/or the numbers of times of ink replenishment in the RAM (not illustrated) in association with the pieces of identification information read from the IC chips 34, and executes integration, counting, and the like of these values.

When the ink consumption amounts are integrated, the measurement portion 50*d* reads the ink consumption amounts from the IC chips 34 when the ink jet printer 1 is activated or when the ink cartridges 30 are set in the mounting portions 22. The measurement portion 50*d* adds the amounts of inks supplied to the print head 41 to the ink consumption amounts read from the IC chips 34. The measurement portion 50*d* writes the added ink consumption amounts into the IC chips 34 when the ink jet printer 1 is powered OFF or at arbitrary timing.

When the ink consumption amounts are integrated, the measurement portion 50*d* may integrate the amounts of inks to be supplied in a flashing operation, a cleaning operation for maintenance of the print head 41 in addition to the amounts of inks supplied in the printing operation by the print head 41.

When the numbers of times of ink replenishment are counted, the measurement portion 50*d* reads the numbers of times of ink replenishment from the IC chips 34 when the ink jet printer 1 is activated or when the ink cartridges 30 are set in the mounting portions 22. Each time the replenishment button 100*c* (FIG. 5) is operated, the measurement portion 50*d* increments the number of times of ink replenishment. The measurement portion 50*d* writes the counted numbers of times of ink replenishment into the IC chips 34 when the ink jet printer 1 is powered OFF or at arbitrary timing.

The motor load determination portion 50*e* acquires and determines the states of the loads for the respective pump motors 25 corresponding to the respective ink colors. Specifically, the motor load determination portion 50*e* acquires load values of the pump motors 25. For example, a method in which the load values are acquired based on the voltages or currents supplied to the pump motors 25, which have been generated by the motor control ICs (not illustrated), and rotation speeds of the pump motors 25, which are obtained from detection values of the pump motor rotation detection portions 27, may be used. In this case, for example, by storing data obtained by mapping a relationship among the voltage of the pump motor 25, the rotation speed of the pump motor 25, and the load value in the ROM or the storage portion 70, the motor load determination portion 50*e* can quickly acquire the load value with reference to the map.

The motor load determination portion 50*e* compares the acquired load value and a load threshold value to determine which is larger, and thereby determines that the load state is an overloaded state when the load value is larger than the load threshold value. The load threshold value is a value set in advance as a threshold value for determining, by the motor load determination portion 50*e*, whether or not the pump motor 25 is overloaded, and is stored in advance in the ROM or the storage portion 70, for example.

Further, the motor load determination portion 50*e* compares two load values acquired at a predetermined time interval to determine which is larger, and thereby determines that the load of the pump motor 25 is increased when the acquired load value after a lapse of a predetermined time is larger.

As elements changing the load of each pump motor 25, a state of clogging of the filter 33 and a viscosity of the ink are listed. In other words, it is possible to estimate the clogging state of the filter 33 by determining the load of the pump motor 25 but it is desirable to consider the viscosity of the ink in this estimation. A correlation between the viscosity of the ink and the temperature of the ink is given by the Andrade's equation, for example. Therefore, it is possible to obtain information about the state of the clogging of the filter 33 based on the load of the pump motor 25, which is determined by the motor load determination portion 50*e*, and the temperature of the ink, which is detected by the temperature sensor 28.

The ink temperature determination portion 50*f* determines whether or not the temperature of the ink is equal to or higher than a preset temperature threshold value based on the detection value detected by the temperature sensor 28. The temperature threshold value is set in consideration of the correlation between the temperature and the viscosity of the ink, and is stored in the storage portion 70 in advance. The ink temperature determination portion 50*f* individually performs determination on the detection values by the plurality of temperature sensors 28 provided so as to correspond to the ink cartridges 30*a* to 30*d*.

The state estimation portion 50*g* estimates the states of the filters 33 included in the respective ink cartridges 30*a* to 30*d* based on the measurement results of the measurement portion 50*d*, the determination results of the motor load determination portion 50*e*, and the determination results of the ink temperature determination portion 50*f*.

The state estimation portion 50*g* estimates the states of the filters 33 based on the ink passage amounts obtained from the measurement results of the measurement portion 50*d* as a first estimation operation.

In the ink jet printer 1, a first ink amount threshold value, a second ink amount threshold value, and a third ink amount threshold value (liquid amount threshold value) are provided as threshold values for estimating the state of the filter 33 from the ink passage amount. These threshold values are set in consideration of, for example, such as a material configuring the filter 33 and stored in the storage portion 70 in advance. The third ink amount threshold value is a threshold value for determining a state in which the clogging occurs in the filter 33, the second ink amount threshold value is smaller than the third ink amount threshold value, and the first ink amount threshold value is smaller than the second ink amount threshold value.

By comparing the ink passage amount with the third ink amount threshold value, the state estimation portion 50*g* estimates that, when the ink passage amount is equal to or larger than the third ink amount threshold value, ink filtering performance is deteriorated to be equal to or lower than certain performance due to the clogging of the filter 33. This state corresponds to a first state in the invention and is a state in which the filter 33 has reached the so-called end of its lifetime (use limit).

In order to perform notification to the user before the filter 33 actually reaches the use limit, the state estimation portion 50*g* performs estimation based on the first ink amount threshold value and the second ink amount threshold value. Specifically, the state estimation portion 50*g* compares the ink passage amount with the second ink amount threshold value to determine which is larger, and thereby estimates that the state of the filter 33 is close to the use limit. Further, the state estimation portion 50*g* compares the ink passage amount with the first ink amount threshold value to determine which is larger, and thereby estimates that the state of the filter 33 is relatively close to the use limit.

As a second estimation operation, the state estimation portion 50*g* estimates the states of the filters 33 based on the determination results of the motor load determination portion 50*e* and the determination results of the ink temperature determination portion 50*f*. Specifically, when the motor load determination portion 50*e* determines that the pump motor 25 is in an overloaded state and the ink temperature determination portion 50*f* determines that the temperature of the ink is equal to or higher than the temperature threshold value, the state estimation portion 50*g* estimates that the state of the filter 33 is a state in which the clogging occurs. In this embodiment, this estimated state corresponds to a second state in the invention and a state in which rapid replacement of the filter 33 is recommended.

A method in which the state estimation portion 50*g* estimates the first state is a method in which the ink passage amount passing through the filter 33 is detected or measured for estimation based on the ink passage amount. This method has an advantage that it is possible to easily estimate the state of the filter. A method in which the state estimation portion 50*g* estimates the second state is a method in which the state of the filter is estimated based on the operation state of the pump motor 25. In other words, the state estimation portion 50*g* detects or measures an influence of the state of the filter 33 on an operation state of the ink jet printer 1, and estimates the state of the filter based on the detection result or the measurement result. With this method, estimation is performed based on the result of actual detection or measurement of the operation state of the ink jet printer 1. It is therefore possible to more accurately estimate the state of the filter 33 as compared with the method in which the first state is estimated.

The cartridge replacement determination portion 50*h* determines whether or not each of the ink cartridges 30*a* to 30*d* mounted on the mounting portions 22*a* to 22*d* has been replaced by another ink cartridge 30. As described above, the reading controller 50*c* reads the identification information from the IC chip 34 when the ink cartridge 30 is mounted on any of the mounting portions 22*a* to 22*d*, and stores the identification information in the RAM or the storage portion 70 of the controller 50. The identification information is stored in association with each of the mounting portions 22*a* to 22*d*. The cartridge replacement determination portion 50*h* determines whether or not the ink cartridge 30 has been replaced based on whether or not the identification information read from the IC chip 34 matches with the identification information stored before for each of the mounting portions 22*a* to 22*d*.

Based on the determination results of the state estimation portion 50*g* and the cartridge replacement determination portion 50*h*, the notification controller 50*i* performs notification by displaying information on the display panel 20*a* for each of the ink cartridges 30*a* to 30*d*.

FIGS. 6 to 9 illustrate specific examples of the notification.

Figure 6:
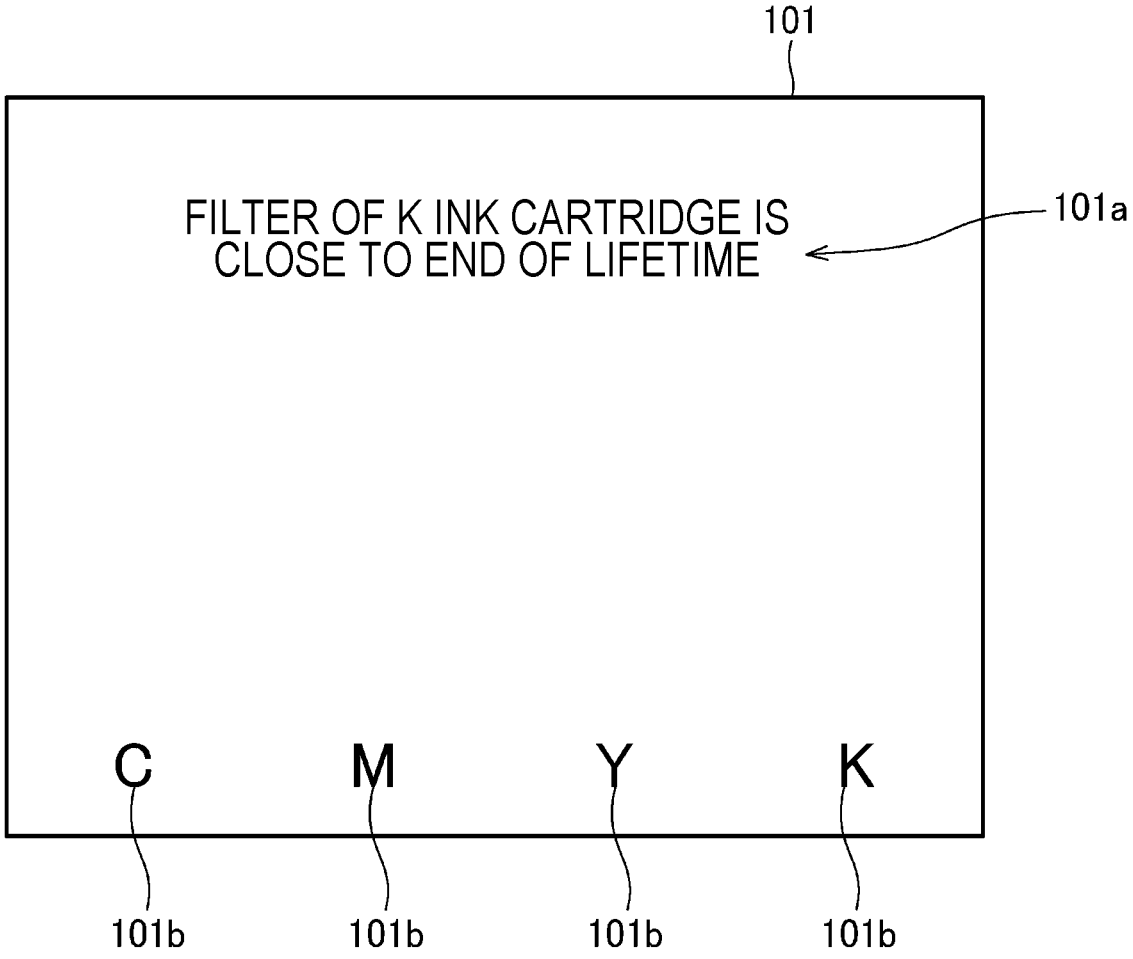
FIG. 6 is a view illustrating another example of the screen that is displayed on the display panel.

FIG. 6 is a view illustrating another example of the screen that is displayed on the display panel 20*a*, and illustrates an example of a pre-screen 101 for performing notification related to the lifetime of the filter.

On the pre-screen 101 in FIG. 6, a message 101*a* notifying the user of the fact that the state of the filter 33 is close to the use limit is displayed. The message 101*a* contains information for specifying any of the ink cartridges 30*a* to 30*d* as a notification target among the ink cartridges 30*a* to 30*d* mounted on the mounting portions 22*a* to 22*d*. As illustrated in FIG. 6, similarly to the display screen 100 (FIG. 5), on the pre-screen 101, characters 101*b* indicating the ink colors may be displayed so as to correspond to the positions of the ink cartridges 30*a* to 30*d*.

The pre-screen 101 is a screen that is displayed when the state of the filter 33 is a state in which it is not to be urgently replaced but the use limit is close. For example, when the state estimation portion 50*g* estimates that the state of the filter 33 is relatively close to the use limit based on the first ink amount threshold value, the notification controller 50*i* controls to display the pre-screen 101.

Figure 7:
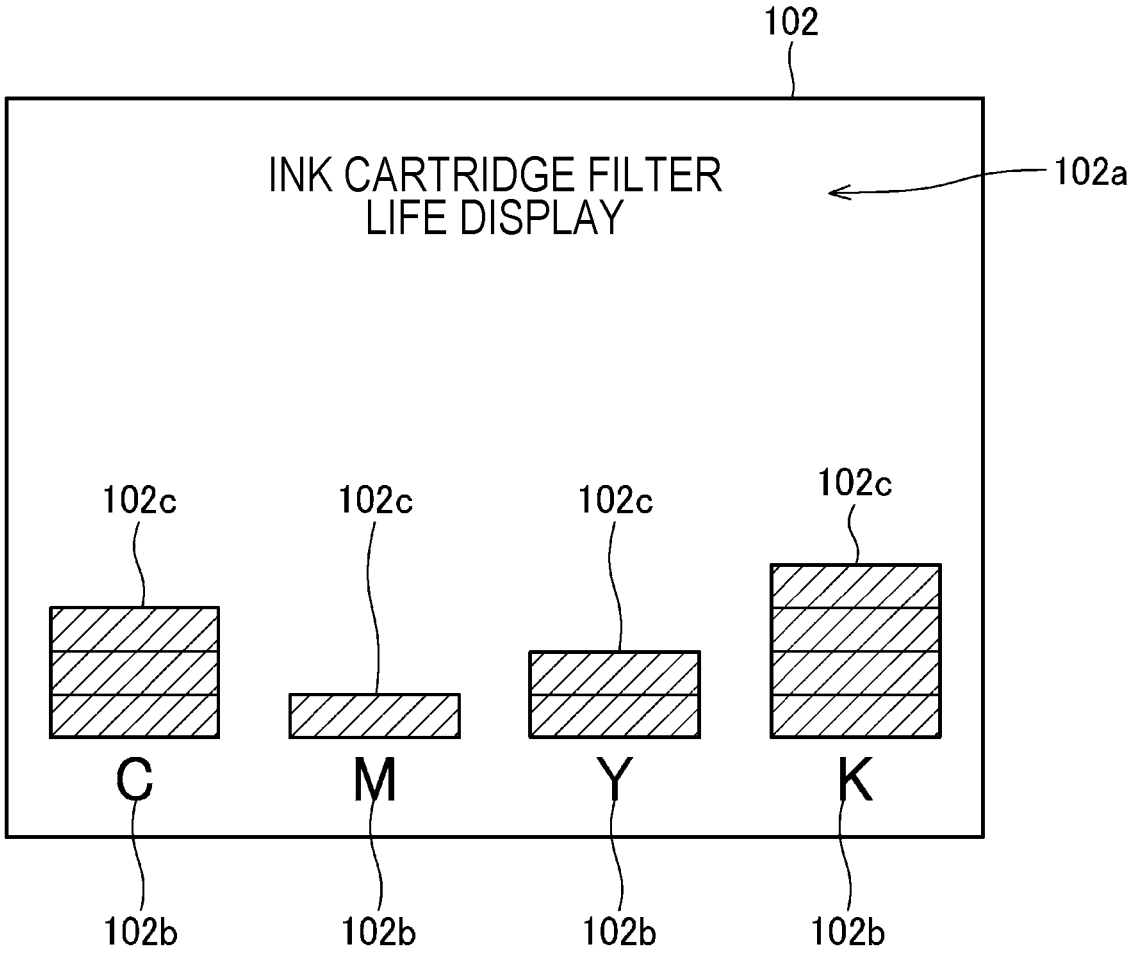
FIG. 7 is a view illustrating still another example of the screen that is displayed on the display panel.

FIG. 7 is a view illustrating still another example of the screen that is displayed on the display panel 20*a*, and illustrates an example of a filter life screen 102 for performing notification related to the filter lifetime.

On the filter life screen 102 in FIG. 7, characters 102*b* indicating the ink colors and graphs 102*c* indicating the states of the filters 33 included in the respective ink cartridges 30*a* to 30*d* are displayed so as to correspond to the positions of the ink cartridges 30*a* to 30*d*. The graphs 102*c* are graphs indicating the ink passage amounts of the respective filters 33 in stages as the pieces of information indicating the states of the filters 33. One scale of each graph 102*c* indicates the ink passage amount of 1 L, for example. Since the display of the ink passage amount can be said to indicate the lifetime (life) of the filter 33, a message 102*a* indicating display of the filter life is displayed on the filter life screen 102.

The filter life screen 102 is a screen for notifying the user of the states of the filters 33, and is displayed when any of the filters 33 is in a state close to the use limit. Thus, for example, when the state estimation portion 50*g* estimates that the state of any of the filters 33 is close to the use limit based on the second ink amount threshold value, for example, the notification controller 50*i* controls to display the filter life screen 102. Note that the filter life screen 102 can be displayed even if no filter 33 is in the state close to the use limit.

Figure 8:
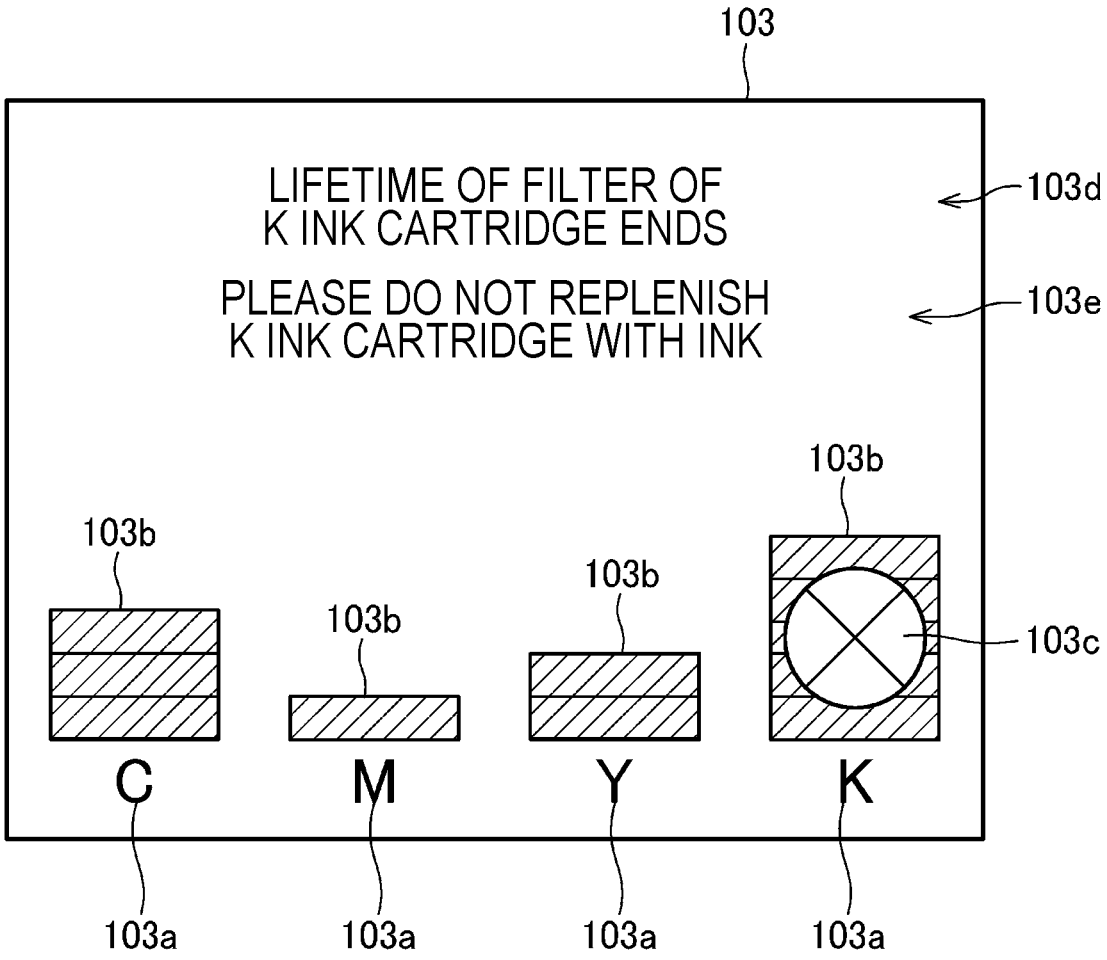
FIG. 8 is a view illustrating still another example of the screen that is displayed on the display panel.

FIG. 8 is a view illustrating still another example of the screen that is displayed on the display panel 20*a*, and illustrates a warning screen 103 for performing notification related to the lifetime of the filter.

Similarly to the filter life screen 102 in FIG. 7, on the warning screen 103 in FIG. 8, characters 103*a* indicating the ink colors and graphs 103*b* indicating the ink passage amounts of the filters 33 are displayed so as to correspond to the positions of the ink cartridges 30*a* to 30*d*.

On the warning screen 103, a predetermined mark 103*c* indicating prohibition of ink replenishment to the ink cartridge 30 can be additionally displayed at a position corresponding to the graph 103*b*. The mark 103*c* is an image which visually strongly prevents a user's action of replenishing the ink cartridge 30 of interest with the ink, and is a kind of notification.

On the warning screen 103, messages 103*d* and 103*e* are displayed. The message 103*d* is a message indicating the end of the lifetime of the filter 33 of the ink cartridge 30. The message 103*e* is a message for preventing further ink replenishment.

The warning screen 103 is a screen that is displayed when the state of the filter 33 has reached the end of its lifetime. For example, when the state estimation portion 50*g* estimates that the state of the filter 33 is the state in which the filter 33 has reached the end of its lifetime (the use limit) (first state) based on the third ink amount threshold value, the notification controller 50*i* controls to display the warning screen 103.

Figure 9:
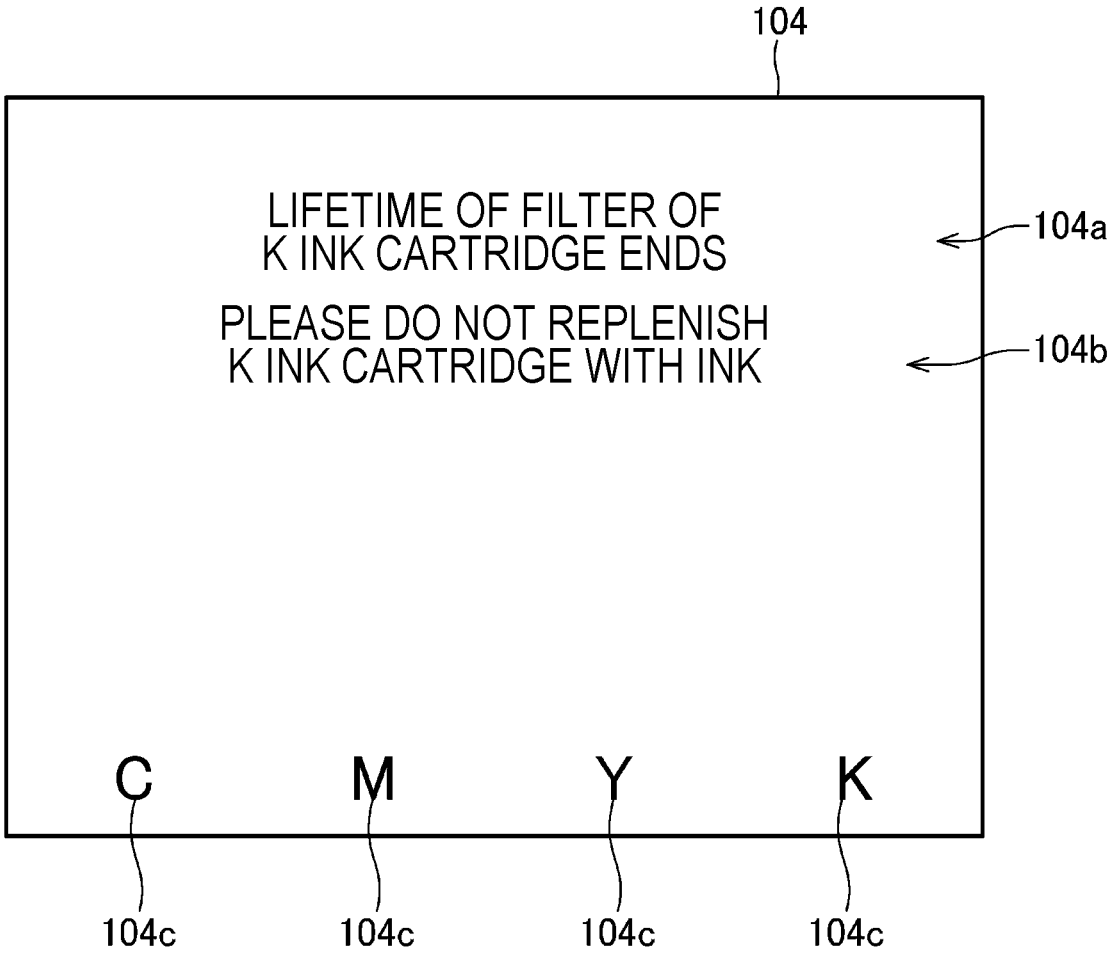
FIG. 9 is a view illustrating still another example of the screen that is displayed on the display panel.

FIG. 9 illustrates still another example of the screen that is displayed on the display panel 20*a*, and illustrates an example of a warning screen 104.

On the warning screen 104 in FIG. 9, similarly to the messages 103*d* and 103*e* on the warning screen 103 (FIG. 8), messages 104*a* and 104*b* related to the filter 33 are displayed. The message 104*a* is a message indicating the end of the lifetime of the filter 33 of the ink cartridge 30. The message 104*b* is a message for preventing further ink replenishment.

In addition, on the warning screen 104, similarly to the filter life screen 102 in FIG. 7, characters 104*c* indicating the ink colors are displayed so as to correspond to the positions of the ink cartridge 30*a* to 30*d*, but the display of the graphs 102*c* (FIG. 7) is omitted.

The warning screen 104 is displayed, for example, at the same timing or under the same condition as the warning screen 103 (FIG. 8).

Figure 10:
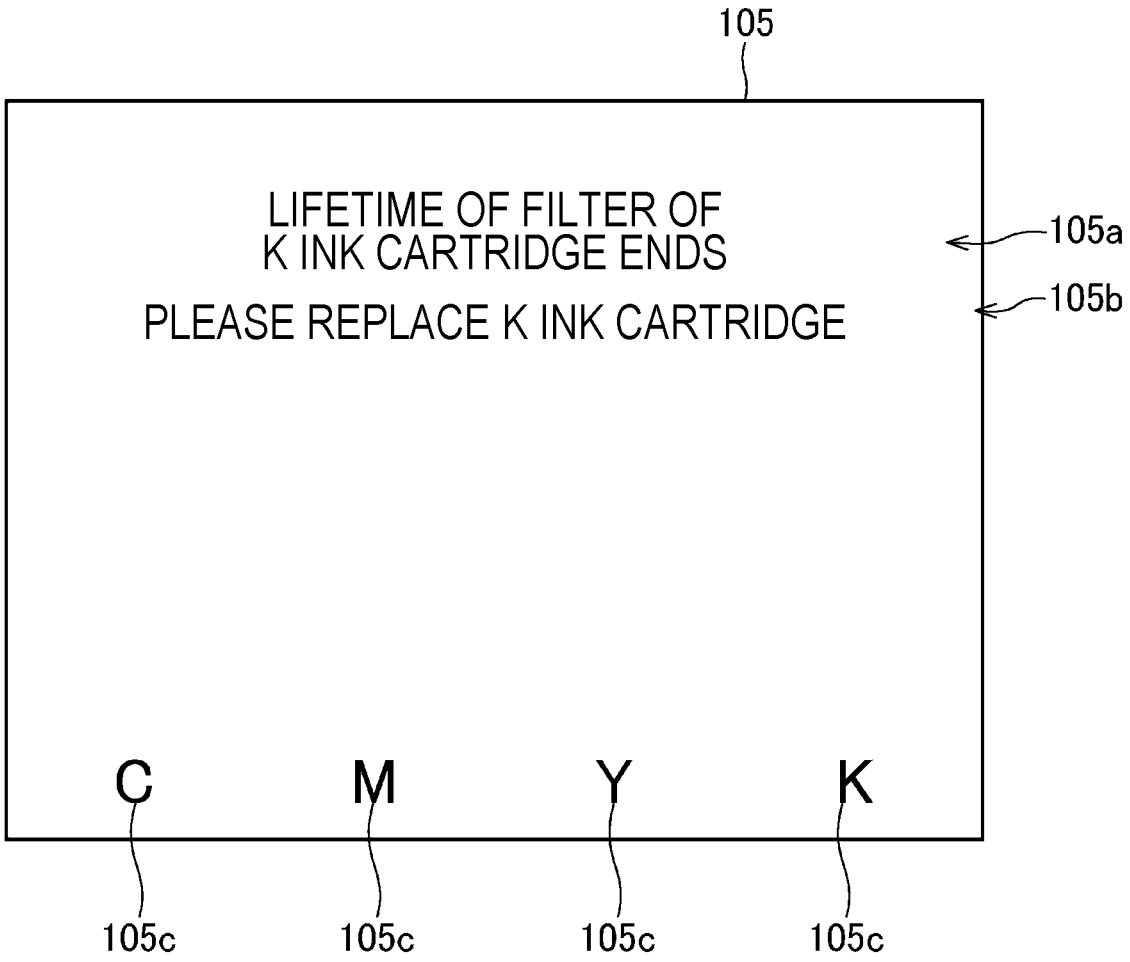
FIG. 10 is a view illustrating still another example of the screen that is displayed on the display panel.

FIG. 10 is a view illustrating still another example of the screen that is displayed on the display panel 20*a*, and illustrates a strong warning screen 105 for performing notification related to filter replacement.

On the warning screen 105 in FIG. 10, messages 105*a* and 105*b* related to the filter 33 are displayed. The message 105*a* is a message indicating the end of the lifetime of the filter 33 of the ink cartridge 30. The message 105*b* is a message prompting replacement of the ink cartridge 30.

In addition, on the warning screen 105, similarly to the filter life screen 102 in FIG. 7, characters 105*c* indicating the ink colors are displayed so as to correspond to the positions of the ink cartridge 30*a* to 30*d*, but the display of the graphs 102*c* (FIG. 7) is omitted.

The warning screen 105 is a screen that is displayed when clogging occurs in the filter 33 and the filter 33 needs to be replaced. For example, when the state estimation portion 50*g* estimates that the state of the filter 33 is in a state in which the clogging occurs (second state) based on the determination result of the motor load determination portion 50*e* and the determination result of the ink temperature determination portion 50*f*, the notification controller 50*i* controls to display the warning screen 105.

In accordance with the determination result of the motor load determination portion 50*e*, the notification controller 50*i* can perform notification (warning) prompting the replacement of the filter 33 and preventing replenishment of the ink cartridge 30 with the ink more strongly. For example, when it is estimated that the clogging in the filter 33 is more advanced than the second state after the notification is made by displaying the warning screen 105, a stronger warning may be performed. Specifically, a screen containing a message recommending replacement of the filter 33 with stronger representation than the warning screen 105 may be displayed.

To be specific, when the motor load determination portion 50*e* determines that the load of the pump motor 25 has been increased after the warning screen 105 is displayed, the notification controller 50*i* controls to display the screen containing the stronger warning. This screen is a screen in which, for example, a message contained in the warning screen 105 is represented by language expression that recommends replacement more strongly, or the like.

Further, the notification controller 50*i* may perform a stronger warning according to the determination result of the cartridge replacement determination portion 50*h*. Specifically, when the ink cartridge 30 is detected to be detached and attached after the warning screen 105 is displayed and the cartridge replacement determination portion 50*h* determines that the ink cartridge 30 after the replacement is not a new one, a stronger warning may be performed. In this case, the notification controller 50*i* may control to display a screen containing the strong warning or may repeatedly control to display the warning screen 105. In the case of the strong warning, the color or format of characters, images, and the like may be changed. For example, the size of the characters may be larger than the size of a normal warning, or the color of the characters may be changed to a conspicuous color such as red.

Figure 11:
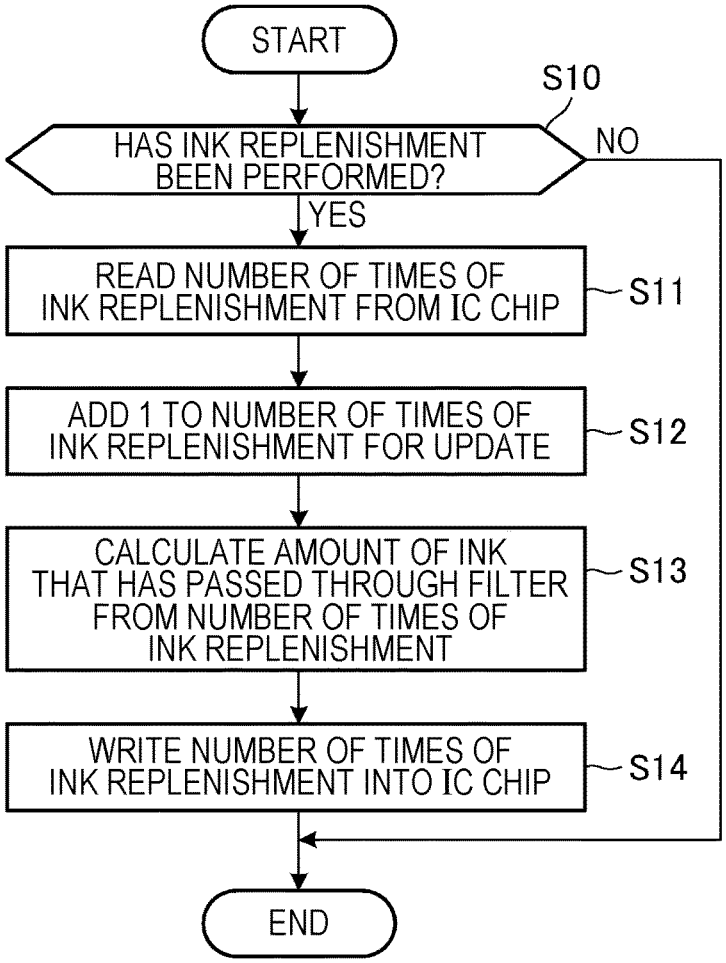
FIG. 11 is a flowchart illustrating an operation of the ink jet printer.
Figure 12:
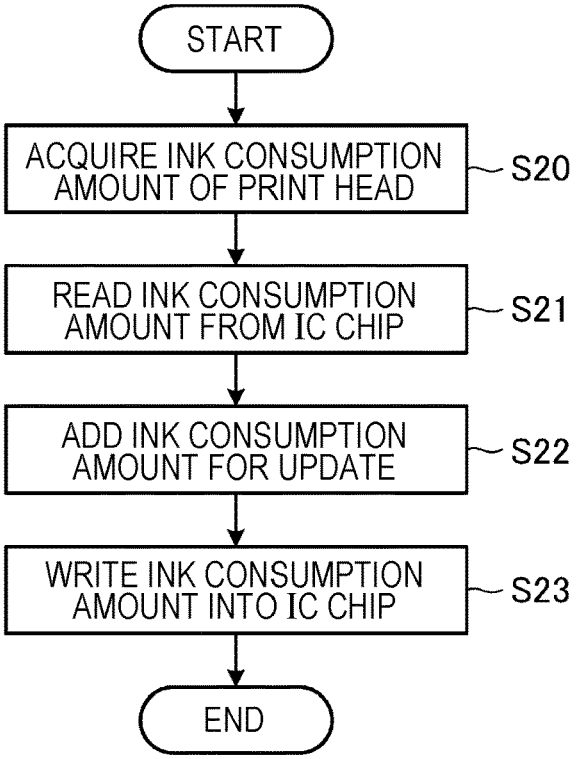
FIG. 12 is a flowchart illustrating an operation of the ink jet printer.
Figure 13:
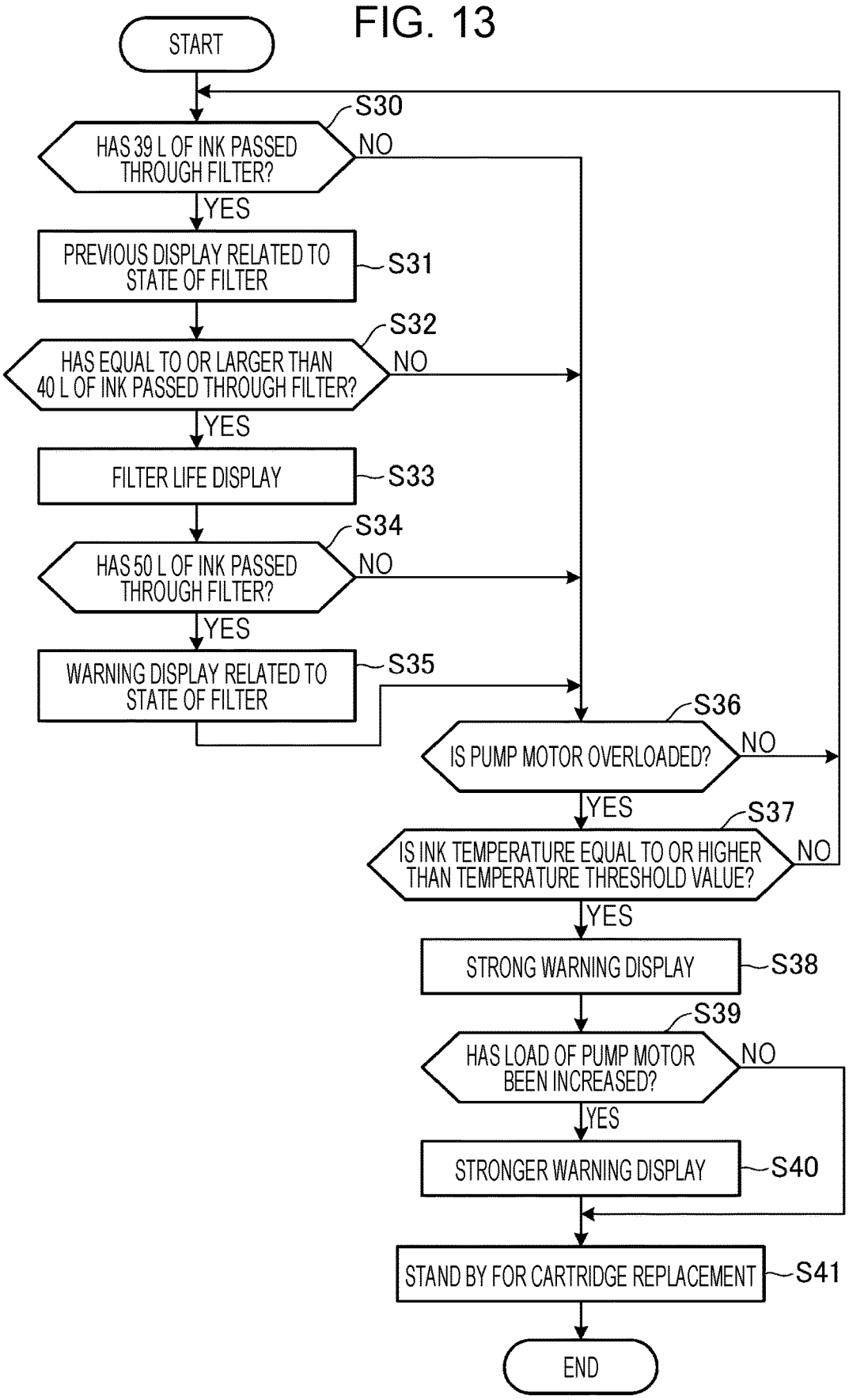
FIG. 13 is a flowchart illustrating an operation of the ink jet printer.

FIGS. 11 to 14 are flowcharts illustrating operations of the ink jet printer 1. The operations illustrated in FIG. 11, FIG. 12, and FIG. 13 are executed for each of the ink cartridges 30*a*, 30*b*, 30*c*, and 30*d* by the controller 50.

The flowchart in FIG. 11 illustrates the operation of counting the number of times of ink replenishment.

The controller 50 determines whether or not the ink cartridge 30 mounted on the mounting portion 22 has been replenished with the ink (step S10). At step S10, the controller 50 determines whether or not ink replenishment has been performed based on whether or not an operation on the replenishment button 100*c* (FIG. 5) has been detected. As described above, the replenishment buttons 100*c* are disposed so as to correspond to the respective ink cartridges 30*a* to 30*d*. When the controller 50 detects the operation on the replenishment button 100*c*, it determines that the ink cartridge 30 corresponding to the operated replenishment button 100*c* has been replenished with the ink. When it is determined that the ink replenishment has not been performed (No at step S10), the controller 50 ends this process.

When it is determined that the ink replenishment has been performed (Yes at step S10), the controller 50 controls the reading portion 23 to read the number of times of ink replenishment from the storage area 342 of the IC chip 34, and temporarily stores it in the RAM or the storage portion 70 (step S11). The controller 50 adds 1 to the number of times of ink replenishment, which has been stored temporarily, to update the number of times of ink replenishment (step S12).

The controller 50 calculates the ink passage amount based on the updated number of times of ink replenishment and the predetermined value as the ink replenishment amount for one time (step S13). The calculated ink passage amount is stored in the RAM or the storage portion 70 in association with the identification information read from the IC chip 34. The controller 50 writes the number of times of replenishment updated at step S12 into the IC chip 34 by the reading portion 23 (step S14), and ends this process.

The controller 50 may execute the operation in FIG. 11 every time the ink cartridge 30 is mounted on the mounting portion 22. For example, an operation on the replenishment button 100*c* may be received only within a predetermined time after the ink cartridge 30 is mounted. Alternatively, the operation on the replenishment button 100*c* may be always received while the ink jet printer 1 is in an ON state.

The flowchart in FIG. 12 illustrates an operation of measuring the ink consumption amount.

The controller 50 acquires an ink discharge amount from the print head 41 (step S20). When the print head 41 is driven under control by the controller 50, the controller 50 calculates the amount of ink ejected by driving the print head 41, and acquires the calculated amount of ink at step S20. Further, for example, the unit of the ink consumption amount acquired at step S20 by the controller 50 may be larger than the unit that is used for controlling the operation of the print head 41.

The controller 50 reads the ink consumption amount from the storage area 342 of the IC chip 34 by the reading portion 23, and temporarily stores it in the RAM or the storage portion 70 (step S21). The controller 50 adds the ink discharge amount acquired at step S20 to the temporarily stored ink consumption amount to update the ink consumption amount (step S22). The controller 50 writes the ink consumption amount updated at step S22 into the storage area 342 by the reading portion 23 (step S23), and ends this process.

The ink jet printer 1 performs at least one of the operation illustrated in FIG. 11 and the operation illustrated in FIG. 12 to obtain the ink passage amount. Specifically, when the ink jet printer 1 is set to manage the ink passage amount by counting the number of times of ink replenishment, the operation illustrated in FIG. 11 is executed. In this case, data containing the number of times of ink replenishment is recorded in the storage area 342 of the IC chip 34. Alternatively, when the ink jet printer 1 is set to manage the ink passage amount based on the ink consumption amount, the operation illustrated in FIG. 12 is executed. In this case, data containing the ink consumption amount is recorded in the storage area 342. In either case, the obtained ink passage amount is stored in the storage portion 70 in association with the identification information of the ink cartridge 30, and is referred to in an operation in FIG. 13, which will be described later.

It is also possible to execute both of the operation illustrated in FIG. 11 and the operation illustrated in FIG. 12 by the controller 50. In this case, the controller 50 may store the ink passage amount obtained by the operation illustrated in FIG. 11 and the ink passage amount obtained by the operation illustrated in FIG. 12 in the storage portion 70 as different values. It is sufficient that the controller 50 uses an average value of these values or a larger value as the ink passage amount and refers to it in the operation illustrated in FIG. 13, which will be described later.

The flowchart in FIG. 13 illustrates an operation of estimating and notifying of the state of the filter 33.

In the following description, as an example, the first ink amount threshold value is set to 39 L, the second ink amount threshold value is set to 40 L, and the third ink amount threshold value is set to 50 L.

The controller 50 determines whether or not 39 L of ink has passed through the filter, that is, whether or not the ink passage amount is equal to or larger than 39 L (first ink amount threshold value) (step S30). At step S30, the controller 50 refers to the ink passage amount updated at step S12 (FIG. 11) and/or step S22 (FIG. 12) and stored in the RAM or the storage portion 70 as described above. The same applies to steps S32 and S34, which will be described later.

When the controller 50 determines that the ink passage amount is equal to or larger than 39 L (Yes at step S30), the controller 50 controls to display, on the display panel 20*a*, a screen containing previous information about the lifetime of the filter 33 (for example, the pre-screen 101 in FIG. 6) (step S31), and moves to step S32.

When it is determined that the ink passage amount is smaller than 39 L (No at step S30), the controller 50 moves to step S36.

At step S32, the controller 50 determines whether or not equal to or larger than 40 L of ink has passed through the filter 33, that is, whether or not the ink passage amount is equal to or larger than 40 L (second ink amount threshold value) (step S32). When it is determined that the ink passage amount is smaller than 40 L (No at step S32), the controller 50 moves to step S36.

When it is determined that the ink passage amount is equal to or larger than 40 L (Yes at step S32), the controller 50 controls to display, on the display panel 20*a*, a screen containing information indicating the ink passage amount (for example, the filter life screen 102 in FIG. 7) (step S33).

The controller 50 determines whether or not 50 L of ink has passed through the filter 33, that is, whether or not the ink passage amount is equal to or larger than 50 L (third ink amount threshold value) (step S34). When it is determined that the ink passage amount is smaller than 50 L (No at step S34), the controller 50 moves to step S36.

When it is determined that the ink passage amount is equal to or larger than 50 L (Yes at step S34), the controller 50 moves to step S35. The controller 50 controls to display, on the display panel 20*a*, a screen containing a warning indicating that the filter 33 has reached the end of the lifetime and ink replenishment is therefore limited (for example, the warning screen 103 in FIG. 8) (step S35), and then moves to step S36.

At step S36, the controller 50 determines whether or not the pump motor 25 is overloaded (step S36). When it is determined that the pump motor 25 is not overloaded (No at step S36), the controller 50 returns to step S30. When it is determined that the pump motor 25 is overloaded (Yes at step S36), the controller 50 determines whether or not the ink temperature detected by the temperature sensor 28 is equal to or higher than the temperature threshold value (step S37).

When the ink temperature is low, it may be determined that the load value of the pump motor 25 exceeds the load threshold value due to the high viscosity of the ink. Therefore, when it is determined that the ink temperature is lower than the temperature threshold value (No at step S37), the controller 50 returns to step S30.

When it is determined that the temperature of the ink is equal to or higher than the temperature threshold value (Yes at step S37), the controller 50 moves to step S38. At step S38, the controller 50 controls to display, on the display panel 20*a*, a screen containing a warning prompting replacement of the filter 33 (for example, the warning screen 105 in FIG. 10) (step S38), and moves to step S39.

After the screen containing the warning is displayed at step S38, the controller 50 determines whether or not the load of the pump motor 25 has been increased (step S39). Specifically, the controller 50 compares the value of the load of the pump motor 25, which has been acquired before the warning screen is displayed at step S38, and the value of the load of the pump motor 25, which has been acquired after the lapse of a predetermined time, and determines whether or not the value of the load has been increased.

When it is determined that the load of the pump motor 25 has been increased (Yes at step S39), the controller 50 controls to display, on the display panel 20*a*, a screen containing a stronger warning than the screen displayed at step S38 (step S40), and moves to step S41.

When it is determined that the load of the pump motor 25 has not been increased (No at step S39), the controller 50 continues the display of the warning displayed at step S38, and moves to step S41.

At step S41, the controller 50 shifts to a state of standing by for replacement of the ink cartridge 30 (step S41), and ends this process. In the stand-by state to which the state has shifted at step S41, the controller 50 stands by for the replacement of the target ink cartridge 30 for which the pieces of processing at steps S30 to S40 have been performed among the ink cartridges 30*a* to 30*d*. In the stand-by state, the display of the screen displayed at step S38 or step S40 is maintained for the target ink cartridge 30. In the stand-by state, various functions of the ink jet printer 1, such as printing by the printing portion 40, maintenance of the print head 41, and communication with the host computer (not illustrated), can be performed. In the stand-by state, the operation illustrated in FIG. 12 can be continuously executed, and the ink passage amount is added and updated in response to supply of the ink to the print head 41. In the stand-by state, determination whether or not the load of the pump motor 25 has been increased at step S39 may be repeated. When it is determined that the load has been increased, a screen containing a stronger warning may be displayed as displayed at step S40.

The stand-by state to which the state has shifted at step S41 is a stand-by state for the target ink cartridge 30. In the stand-by state, the controller 50 can execute the operation in FIG. 13 from step S30 for the ink cartridges 30 other than the target ink cartridge 30.

When it is detected that the target ink cartridge 30 is detached from the mounting portion 22 and another ink cartridge 30 is mounted in the stand-by state to which the state has shifted at step S41, the controller 50 returns to step S30. In this case, the controller 50 may switch the display on the display panel 20*a* to a screen of a normal state (for example, the display screen 100 in FIG. 5) and then return to step S30.

Figure 14:
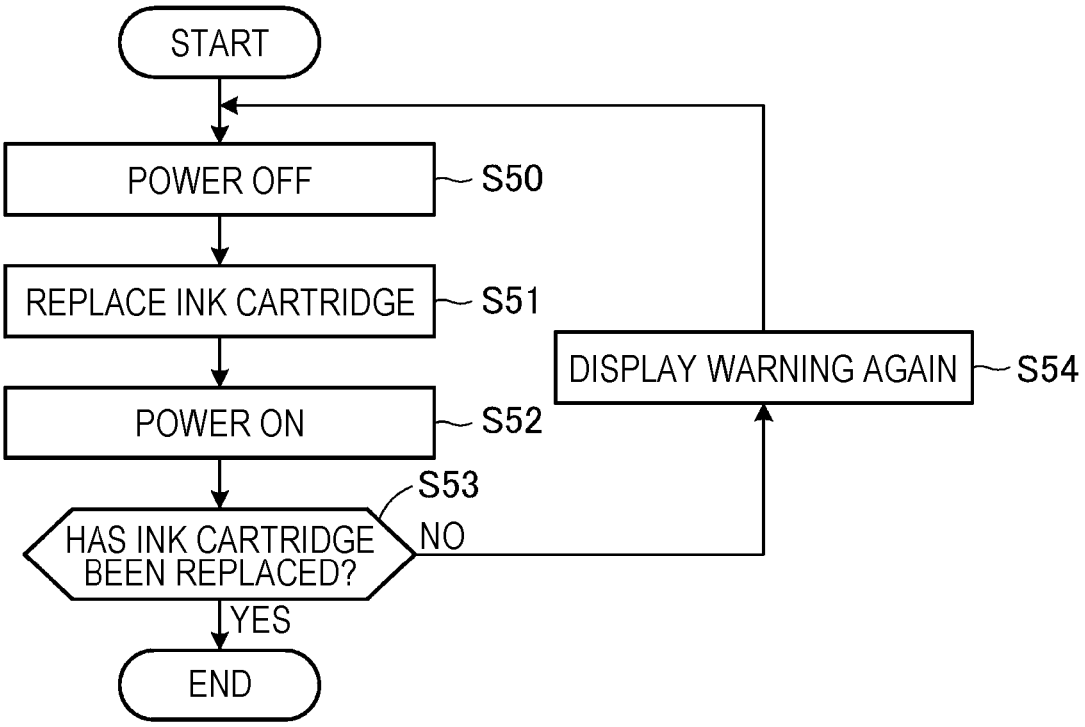
FIG. 14 is a flowchart illustrating an operation of the ink jet printer.

When the screen containing the warning is displayed at step S38 or step S40, there is a possibility that the user powers OFF the ink jet printer 1 and replaces the ink cartridge 30. In other words, after shifting to the stand-by state at step S41, the ink jet printer 1 is powered OFF in some cases. FIG. 14 illustrates an operation of the controller 50 in this case.

The flowchart of FIG. 14 illustrates the operation when the power supply is turned OFF in the stand-by state.

When the user replaces the ink cartridge 30 of the color displayed on the warning screen, that is, the target ink cartridge 30 by the new ink cartridge 30, the user may switch the ink jet printer 1 into the OFF state (step S50).

In this case, the user detaches the ink cartridge 30 from the mounting portion 22 and mounts the new ink cartridge 30 on the mounting portion 22 while the ink jet printer 1 is in the OFF state (step S51). After the replacement of the ink cartridge 30, the user switches the ink jet printer 1 into the ON state (step S52).

In the case in which the ink jet printer 1 is powered OFF and ON in the stand-by state to which the state has shifted at step S41 (FIG. 13), the controller 50 determines whether or not the ink cartridge 30 that has been in the stand-by state for replacement has been replaced by another ink cartridge 30 (step S53).

That is, the controller 50 specifies the mounting portion 22 on which the target ink cartridge 30 in the stand-by state has been mounted, reads the identification information from the IC chip 34 by the reading portion 23 corresponding to the specified mounting portion 22, and compares the read identification information with the previously read identification information. When the pieces of identification information match with each other, the ink cartridge 30 is not replaced.

When it is determined that the ink cartridge 30 has not been replaced (No at step S53), the controller 50 controls to display, on the display panel 20*a*, the screen containing the warning again (step S54) and returns to the stand-by state. The screen displayed at step S53 may be the same as the screen displayed in the stand-by state, or may be a screen containing a warning that requires the replacement of the ink cartridge 30 more strongly.

When it is determined that the ink cartridge 30 has been replaced (Yes at step S53), the controller 50 ends this process. Thereafter, the operation in FIG. 11 or 12 and the operation in FIG. 13 are performed.

As described above, the ink jet printer 1 according to the embodiment includes the ink cartridge 30 that has the storage chamber 31 for storing therein the ink and that enables the storage chamber 31 to be replenished with the ink. The ink jet printer 1 includes the print head 41 that ejects the ink supplied from the storage chamber 31 via the filter 33. The ink jet printer 1 includes the state estimation portion 50*g* that estimates the state of the filter 33, and the display panel 20*a* for notification. The ink jet printer 1 performs different notification through the display panel 20*a* in accordance with the estimated state by the state estimation portion 50*g*.

According to the ink jet printer 1 to which the liquid ejecting apparatus of the invention is applied, the state of the filter 33 through which the ink passes is estimated, and notification to the user is performed in accordance with the state of the filter 33. As a result, it is possible to notify the user of the state of the filter 33, thereby reducing the burden on the management of the state of filter 33, and the like.

Further, when the amount of ink supplied via the filter 33 is equal to or larger than the third ink amount threshold value, the state estimation portion 50*g* estimates that the filter 33 has reached the end of its lifetime and is in the first state in which the predetermined clogging occurs. Thus, by comparing the amount of ink supplied via the filter 33 with the third ink amount threshold value, it is possible to accurately estimate whether the filter 33 is in the state in which the predetermined clogging occurs.

Further, the ink jet printer 1 includes the pump 24 which sucks the ink supplied from the storage chamber 31 via the filter 33 and delivers the ink to the print head 41. When the load value of the pump motor 25 included in the pump 24 is larger than the load threshold value, the state estimation portion 50*g* estimates that the filter 33 is in the second state in which the predetermined clogging occurs. Thus, by comparing the load value of the pump motor 25 of the pump 24 sucking the ink supplied via the filter 33 with the load threshold value, it is possible to accurately estimate whether the filter 33 is in the state in which the predetermined clogging occurs.

When the state of the filter 33 is the first state in which the filter 33 has reached the end of its lifetime, the ink jet printer 1 performs notification indicating limitation of the ink replenishment to the storage chamber 31 of the ink cartridge 30. When the state of the filter 33 is the second state in which the clogging occurs, the ink jet printer 1 further performs notification related to the replacement of the ink cartridge 30.

With this manner, it is possible to perform the notification corresponding to each of the plurality of states of the filter 33. By notifying the user of the limitation of the ink replenishment, it is possible to prevent ink replenishment after the filter 33 has reached the end of its lifetime (use limit). Therefore, it is possible to avoid a situation in which the ink in the storage chamber 31 cannot be used due to exceeding of the use limit of the filter 33, thereby improving the convenience of the user. In addition, when the user replaces the ink cartridge 30 by the notification prompting the user to replace the ink cartridge 30, the filter 33 can be replaced.

Further, when the state estimation portion 50*g* estimates that the filter 33 is in a state before the clogging occurs, the ink jet printer 1 performs notification related to the clogging of the filter 33 through the display panel 20*a*. When it is estimated that the state of the filter 33 is the state before the clogging occurs, it is therefore possible to notify the user of the fact that the filter 33 is close to the end of its lifetime because it is close to the use limit of the filter 33. With this notification, for example, the user can prepare in advance the ink cartridge 30 of a color, which is close to the end of its lifetime, thereby improving the convenience of the user.

Further, the ink jet printer 1 includes the measurement portion 50*d* that measures the ink passage amount as the amount of ink supplied via the filter 33. The state estimation portion 50*g* estimates the state of the filter 33 based on the ink amount measured by the measurement portion 50*d*. Accordingly, the state of the filter can be estimated based on the amount of ink that has passed through the filter 33.

Further, the ink cartridge storage portion 21 includes the mounting portion 22 on which the ink cartridge 30 having the storage chamber 31 and the filter 33 can be mounted. Accordingly, the filter 33 can be easily replaced by replacing the ink cartridge 30 mounted on the mounting portion 22, thereby improving the convenience of the user.

The ink jet printer 1 includes the reading portion 23 that writes and reads the information indicating the ink amount measured by the measurement portion 50*d* into and from the IC chip 34 included in the ink cartridge 30 mounted on the mounting portion 22. The state estimation portion 50*g* estimates the state of the filter 33 based on the information about the ink amount read from the IC chip 34 by the reading portion 23. Thus, the state of the filter 33 can be estimated using the information stored in the IC chip 34 included in the ink cartridge 30. For example, even when the ink cartridge 30 is used in ink jet printers other than the ink jet printer 1, the state of the filter 33 can be estimated using the information stored in the IC chip 34 even in other ink jet printers.

Further, the ink jet printer 1 includes the temperature sensor 28 that detects the temperature of the ink. The state estimation portion 50*g* estimates the state of the filter 33 based on the temperature of the ink, which is detected by the temperature sensor 28, and the state of load of the pump motor 25. It is therefore possible to estimate the state of the filter 33 more accurately by using the temperature of the ink, which has a correlation with the viscosity of the ink, in addition to the state of the load of the pump 24.

Further, when the load of the pump motor 25 is increased after notification related to the clogging state of the filter 33 through the display panel 20*a*, the ink jet printer 1 changes the state of the notification through the display panel 20*a*. The state of the filter 33 can therefore be further deteriorated, so that stronger notification can be made to the user to prompt the user to replace the ink cartridge 30 more strongly.

Further, the ink cartridge 30 to which the invention is applied includes the ink filling port 32 through which ink can be filled, the storage chamber 31 that stores therein the ink, and the filter 33 that allows the ink to pass through when the ink is supplied from the storage chamber 31 to the outside. The ink cartridge 30 includes the IC chip 34 that is capable of storing information indicating the amount of ink supplied through the filter 33, and the IC chip 34 is capable of storing information until the ink of the volume of equal to or more than two times of the volume of the storage chamber 31 is supplied through the filter 33.

With this configuration, the filter 33 can be replaced by replacing the ink cartridge 30 capable of being replenished with the ink, thereby improving the convenience of the user. Further, the information about the ink that has passed through the filter 33 can be stored in the IC chip 34 of the ink cartridge 30, and the state of the filter 33 can be estimated using the information stored in the IC chip 34. For example, the state of the filter 33 of the ink cartridge 30 can be estimated by reading the information in the IC chip 34 with a printer different from the ink jet printer 1. Further, the state of the filter 33 of the ink cartridge 30 used in another printer can be estimated easily and accurately based on the information stored in the IC chip 34.

In addition, the filter 33 of the ink cartridge 30 can allow the ink of the volume of at least equal to or more than 10 times of the volume of the storage chamber 31 to pass therethrough, and the IC chip 34 can store information corresponding to the upper limit of the amount of ink that can be supplied through the filter 33. With this configuration, information about the ink passage amount can be stored in the IC chip 34 up to the upper limit of the amount that can be supplied through the filter 33. Therefore, the state of the filter 33 can be managed based on the information stored in the IC chip 34 until the state of the filter 33 reaches the so-called end of its lifetime.

Further, in the ink cartridge 30, the IC chip 34 has the storage area 342 storing therein information indicating the amount of ink supplied through the filter 33 using the volume of the storage chamber 31 as a unit and containing the number of times of ink replenishment. Thus, the capacity of the storage area 342 can be reduced. The amount of ink that has passed through the filter 33 can be measured based on the number of times of ink replenishment stored in the IC chip 34 of the ink cartridge 30. Further, when the number of times of ink replenishment is stored in the IC chip 34, the storage area of the IC chip 34 can be reduced.

It is to be understood that the above-described embodiment indicates a specific example to which the invention is applied and the invention is not limited thereto.

For example, in the above embodiment, the state of the filter 33 is estimated based on the ink passage amount, the load of the pump motor 25, and the temperature of the ink, as the example, but the state of the filter 33 may be estimated based on only the ink passage amount.

Alternatively, the state of the filter 33 may be estimated based on only the load of the pump motor 25, or the state of the filter 33 may be estimated based on the load of the pump motor 25 and the temperature of the ink.

In the above embodiment, an example has been described in which whether or not the state of the filter 33 has reached the use limit is determined in stages using the first ink amount threshold value, the second ink amount threshold value, and the third ink amount threshold value. The invention is not limited thereto, and whether or not the filter 33 has reached the use limit may be determined using only one value related to the ink passage amount.

Further, for example, in the above embodiment, the configuration in which the ink cartridge 30 capable of being detached from the ink jet printer 1 can be replenished with the ink is applied, as the example, but the invention is also applicable to other systems. For example, the configuration in which an ink jet printer includes an ink tank storing therein an ink and the ink tank can be replenished with the ink may be employed.

Further, in the above embodiment, the invention is applied to the ink jet printer 1 in which the filter 33 is provided in the ink cartridge 30, and the filter 33 can be replaced by replacing the ink cartridge 30. In this way, when the ink cartridge 30 into which the ink can be added is mounted on an ink jet printer other than the ink jet printer 1 on which the ink cartridge 30 is being mounted, the ink cartridge 30 can be replaced while the lifetime of the filter 33 is managed. As described above, since the ink cartridge 30 that can be replenished with the ink is made detachable from the ink jet printer 1, for example, when there is an ink jet printer in which ink can be insufficient in printing, it is possible to execute (continue) printing with no effort without requiring ink to be moved to the ink jet printer. In other words, it is possible to execute printing only by replacing the ink cartridge 30 in the ink jet printer in which the ink can be insufficient, thereby improving the convenience of the user. Further, the invention is not limited thereto, and the filter 33 may be disposed at a position other than the ink cartridge 30. For example, the invention may be applied to the configuration in which a filter is disposed in an ink flow path in a main body of the ink jet printer 1.

Further, in the above embodiment, the configuration has been described in which notification is performed by displaying the screen containing the warning on the display panel 20*a*, but a method of notification is not limited to the display. For example, data related to the state of the filter 33 may be transmitted from the ink jet printer 1 to the host computer (not illustrated) and the host computer may output notification. Alternatively, a light emitting portion for notification may be provided in the ink jet printer 1, and notification may be made by lighting or blinking the light emitting portion.

Although the ink jet printer 1 is exemplified as an example in which the liquid ejecting apparatus is applied in the above-described embodiment, the invention is not limited thereto and may be applied to a liquid ejecting apparatus that ejects a liquid other than ink. For example, there is a liquid ejecting apparatus which ejects a liquid containing a material such as an electrode material, a coloring material, or the like to be used for manufacturing a liquid crystal display, an EL display, a surface light emitting display, a color filter, or the like, in a dispersed or molten state. The examples of the liquid ejecting apparatus include a liquid ejecting apparatus which ejects a biological organic substance to be used for manufacturing a biochip. There is also a liquid ejecting apparatus which ejects a liquid as a sample, which is to be used as a precision pipette. Further, there are liquid ejecting apparatuses such as a printing apparatus and a microdispenser. Other examples of the liquid ejecting apparatus include a liquid ejecting apparatus which pinpoint-ejects lubricating oil to a precision machine such as a watch or a camera. In addition, a liquid ejecting apparatus which ejects a transparent resin liquid of an ultraviolet curing resin or the like onto a substrate to form a micro hemispherical lens (optical lens) to be used in an optical communication element or the like is also exemplified. In addition, there is a liquid ejecting device which ejects an acid or alkali etching solution for etching a substrate or the like.

Further, in the above embodiment, the ink jet printer 1 for color printing using inks of the four colors of CMYK has been described as an example, but the invention can be applied to full-color printing using inks of multiple colors by adding special color inks to the four colors, monochrome printing, two-color printing, and the like.

The programs that are executed by the CPU of the controller 50 are not limited to be stored in the storage portion included in the ink jet printer 1, and the configuration in which the programs are stored in another storage device, another storage medium, or a storage medium of an external device, and are read and executed by the controller 50 may be employed.

Further, while the controller 50 includes the functional portions 50*a* to 50*i* in the above embodiment, a single processor may execute programs to realize functions of the plurality of functional portions. Some of the functions that are implemented by software may be configured by hardware.

What is claimed is:

1. A liquid ejecting apparatus comprising:

a liquid storage portion that has a storage chamber for storing a liquid and enables the storage chamber to be replenished with the liquid;

a liquid ejection portion that ejects the liquid supplied from the storage chamber via a filter;

a state estimation portion that estimates a state of the filter; and a notification portion that performs notification, wherein in a first state estimated by the state estimation portion, the notification portion performs notification to limit replenishment to the storage chamber with the liquid, and in a second state estimated by the state estimation portion, the notification portion performs notification related to replacement of the liquid storage portion.

2. The liquid ejecting apparatus according to claim 1, wherein the state estimation portion estimates that the filter is in the first state in which predetermined clogging occurs when an amount of the liquid supplied via the filter is larger than a liquid amount threshold value.

3. The liquid ejecting apparatus according to claim 2, including a pump that sucks the liquid supplied from the storage chamber via the filter and delivers the liquid to the liquid ejection portion, wherein the state estimation portion estimates that the filter is in the second state in which predetermined clogging occurs when a load of the pump is larger than a load threshold value.

* * * * *